US012037888B2

(12) United States Patent
Larbi Zeghlache

(10) Patent No.: US 12,037,888 B2
(45) **Date of Patent: *Jul. 16, 2024**

(54) UNTETHERED DOWNHOLE TOOL SYSTEMS AND METHODS

(71) Applicant: SAUDI ARABIAN OIL COMPANY, Dhahran (SA)

(72) Inventor: Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/204,370

(22) Filed: May 31, 2023

(65) Prior Publication Data

US 2023/0304392 A1 Sep. 28, 2023

Related U.S. Application Data

(63) Continuation of application No. 17/538,739, filed on Nov. 30, 2021, now Pat. No. 11,702,925.

(51) Int. Cl.

| | |
|---|---|
| ***E21B 47/01*** | (2012.01) |
| ***E21B 23/00*** | (2006.01) |
| ***E21B 47/09*** | (2012.01) |

(52) U.S. Cl.

CPC ..... *E21B 47/01* (2013.01); *E21B 23/001* (2020.05); *E21B 47/09* (2013.01); *E21B 2200/20* (2020.05)

(58) Field of Classification Search

CPC ..... E21B 47/01; E21B 47/09; E21B 23/001

See application file for complete search history.

(56) References Cited

U.S. PATENT DOCUMENTS 11,702,925 B2 * 7/2023 Zeghlache ..... E21B 47/09 175/45

* cited by examiner

*Primary Examiner* — Giovanna Wright
*Assistant Examiner* — Ronald R Runyan
(74) *Attorney, Agent, or Firm* — Osha Bergman Watanabe & Burton LLP

(57) ABSTRACT

Techniques according to the present disclosure include moving an untethered downhole tool through a wellbore between a terranean surface and a particular depth in the wellbore; during the moving the untethered downhole tool through the wellbore, acquiring a set of sensed data from one or more sensors in the untethered downhole tool in a time domain; transforming the plurality of data values associated with the wellbore parameter in the time-domain into a plurality of data values associated with the wellbore parameter in a depth-domain based at least in part on at least one accelerometer output and the locations of a plurality of casing collars; and preparing the plurality of data values associated with the wellbore parameter in the depth-domain for presentation on a graphical user interface (GUI).

25 Claims, 13 Drawing Sheets

200

| 202 Channel Name | 204 Time | 206 Temp. | 208 P | 210 Temp_cor | 212 T2 | 214 Bx | 216 By | 218 Bz | 220 CCL |
|---|---|---|---|---|---|---|---|---|---|
| 205 Sensor | Time | Temperature | Hydrostatic Pressure | Pressure Corrected Temperature | Time | X-axis Magnetometer | X-axis Magnetometer | X-axis Magnetometer | Tubing Tally |
| 207 Unit | S | °F | psi | °F | S | G | G | G | ft. |
| 209 Type | Time | 1s | 1s | 1s | 0.1s | 0.1s | 0.1s | 0.1s | Depth |
| 211 Sampling Rate | 1s | 1s | 1s | 1s | 0.1s | 0.1s | 0.1s | 0.1s | N/A |

FIG. 2A

UNTETHERED DOWNHOLE TOOL SYSTEMS AND METHODS

CROSS-REFERENCE TO RELATED APPLICATIONS

This application is a continuation of and claims the benefit of priority under 35 U.S.C. § 120 to U.S. patent application Ser. No. 17/538,739, filed on Nov. 30, 2021. The entire content of this application is incorporated herein by reference in its entirety.

TECHNICAL FIELD

The present disclosure describes apparatus, systems, and methods for an untethered downhole tool and, more particularly, determining depth-domain data for a wellbore from time-domain data collected by an untethered downhole tool.

BACKGROUND

During any operation or intervention downhole in an oil and gas well, depth can be a primary measurement. For tethered intervention tools, such as tools connected to a wireline, slickline, coiled tubing, or other downhole conveyance, depth measurement can be conducted based on surface or downhole devices such as drill pipes tally, depth marks, magnetic marks, depth wheels, or otherwise. For untethered downhole tools, such as tools that are not connected to a downhole conveyance and are not equipped to measure depth (directly or indirectly) based on such previously mentioned devices or techniques, the untethered tool can record data over time (in other words, in a time domain). In some aspects, such recorded data must be properly and accurately converted from the time domain into a distance domain (in other words, depth) for meaningful and exploitable data.

SUMMARY

In an example implementation, a method includes moving an untethered downhole tool through a wellbore between a terranean surface and a particular depth in the wellbore, the wellbore including a casing string including a plurality of casing collars; during the moving the untethered downhole tool through the wellbore, acquiring a set of sensed data from one or more sensors in the untethered downhole tool in a time domain, the set of sensed data including a plurality of data values associated with a wellbore parameter in the time-domain, at least one accelerometer output, and locations of the plurality of casing collars; transforming, with one or more hardware processors of a control system, the plurality of data values associated with the wellbore parameter in the time-domain into a plurality of data values associated with the wellbore parameter in a depth-domain based at least in part on the at least one accelerometer output and the locations of the plurality of casing collars; and preparing, with the one or more hardware processors of the control system, the plurality of data values associated with the wellbore parameter in the depth-domain for presentation on a graphical user interface (GUI).

An aspect combinable with the example implementation further includes pre-processing, with the one or more hardware processors of a control system, the plurality of data values associated with the wellbore parameter in the time-domain.

In another aspect combinable with any one of the previous aspects, the pre-processing includes formatting, with the one or more hardware processors of the control system, the plurality of data values associated with the wellbore parameter in the time-domain into a particular file type.

Another aspect combinable with any one of the previous aspects further includes repeating the moving the untethered downhole tool through the wellbore between the terranean surface and the particular depth in the wellbore; and during each repetition of the moving, acquiring a new set of sensed data from the one or more sensors in the untethered downhole tool in the time domain, each new set of data including a plurality of data values associated the a wellbore parameter in the time-domain and at least one new accelerometer output.

In another aspect combinable with any one of the previous aspects, moving the untethered downhole tool through the wellbore between the terranean surface and the particular depth in the wellbore includes moving the untethered downhole tool through the wellbore between the terranean surface and the particular depth in the wellbore independent of a downhole conveyance.

In another aspect combinable with any one of the previous aspects, the transforming includes generating, with the one or more hardware processors of the control system, a concatenated time-series data set of the plurality of data values associated with the wellbore parameter in the time-domain from the pre-processed plurality of data values associated with the wellbore parameter in the time-domain; generating, with the one or more hardware processors of the control system, split data sets from the concatenated time-series data set of the plurality of data values associated with the wellbore parameter, the split data sets including a downlog of a portion of the plurality of data values associated with the wellbore parameter and an uplog of another portion of the plurality of data values associated with the wellbore parameter; and applying, with the one or more hardware processors of the control system, the locations of the plurality of casing collars to the generated split data sets.

In another aspect combinable with any one of the previous aspects, generating the concatenated time-series data set of the plurality of data values associated with the wellbore parameter in the time-domain includes converting, with the one or more hardware processors of the control system, the pre-processed plurality of data values associated with the wellbore parameter in the time-domain into time-series data; transforming, with the one or more hardware processors of the control system, the time-series data into the concatenated time-series data set of the plurality of data values associated with the wellbore parameter in the time-domain; generating, with the one or more hardware processors of the control system, a tubing tally data set; determining, with the one or more hardware processors of the control system, at least two data clipping points based on a wellhead location and total depth of the wellbore based on the plurality of data values associated with the wellbore parameter in the time-domain; and clipping, with the one or more hardware processors of the control system, the concatenated time-series data set at the at least two data clipping points.

In another aspect combinable with any one of the previous aspects, generating split data sets from the concatenated time-series data set of the plurality of data values associated with the wellbore parameter includes splitting, with the one or more hardware processors of the control system, the concatenated time-series data set at the data clipping point that represents the total depth of the wellbore; generating, with the one or more hardware processors of the control system, the downlog of the portion of the plurality of data values associated with the wellbore parameter that occur prior in time to the clipping point that represents the total depth of the wellbore; generating, with the one or more hardware processors of the control system, the uplog of the another portion of the plurality of data values associated with the wellbore parameter that occur subsequent in time to the clipping point that represents the total depth of the wellbore; rescaling, with the one or more hardware processors of the control system, the downlog and the uplog to match a top and a bottom of the tubing tally data set; and aligning, with the one or more hardware processors of the control system, the rescaled downlog and rescaled uplog based on the at least one accelerometer output to generate an initial plurality of data values associated with the wellbore parameter in the depth-domain.

In another aspect combinable with any one of the previous aspects, applying the locations of the plurality of casing collars to the generated split data sets includes executing, with the one or more hardware processors of the control system, a casing collar location detection process to add casing collar locations to the initial plurality of data values associated with the wellbore parameter in the depth-domain; removing, with the one or more hardware processors of the control system, false positive casing collar locations from the initial plurality of data values associated with the wellbore parameter in the depth-domain; and applying, with the one or more hardware processors of the control system, a depth shift to the initial plurality of data values associated with the wellbore parameter in the depth-domain to generate the plurality of data values associated with the wellbore parameter in the depth-domain.

Another example implementation includes an untethered downhole tool system that includes an untethered downhole tool configured to move through a wellbore between a terranean surface and a particular depth in the wellbore independent of a downhole conveyance, the wellbore including a casing string including a plurality of casing collars, the untethered downhole tool including one or more sensors; and a control system communicably coupled to the untethered downhole tool. The control system is configured to perform operations including identifying a set of sensed data acquired from the one or more sensors in a time domain, the set of sensed data including a plurality of data values associated with a wellbore parameter in the time-domain, at least one accelerometer output, and locations of the plurality of casing collars; transforming the plurality of data values associated with the wellbore parameter in the time-domain into a plurality of data values associated with the wellbore parameter in a depth-domain based at least in part on the at least one accelerometer output and the locations of the plurality of casing collars; and preparing the plurality of data values associated with the wellbore parameter in the depth-domain for presentation on a graphical user interface (GUI).

In an aspect combinable with the example implementation, the control system is configured to perform operations including pre-processing the plurality of data values associated with the wellbore parameter in the time-domain.

In another aspect combinable with any one of the previous aspects, the operation of pre-processing includes formatting the plurality of data values associated with the wellbore parameter in the time-domain into a particular file type.

In another aspect combinable with any one of the previous aspects, the control system is configured to perform operations including identifying a new set of sensed data from the one or more sensors in the untethered downhole tool in the time domain taken during repeated movings of the untethered downhole tool through the wellbore between the terranean surface and the particular depth in the wellbore, each new set of data including a plurality of data values associated the a wellbore parameter in the time-domain and at least one new accelerometer output.

In another aspect combinable with any one of the previous aspects, the operation of transforming includes generating a concatenated time-series data set of the plurality of data values associated with the wellbore parameter in the time-domain from the pre-processed plurality of data values associated with the wellbore parameter in the time-domain; generating split data sets from the concatenated time-series data set of the plurality of data values associated with the wellbore parameter, the split data sets including a downlog of a portion of the plurality of data values associated with the wellbore parameter and an uplog of another portion of the plurality of data values associated with the wellbore parameter; and applying the locations of the plurality of casing collars to the generated split data sets.

In another aspect combinable with any one of the previous aspects, the operation of generating the concatenated time-series data set of the plurality of data values associated with the wellbore parameter in the time-domain includes converting the pre-processed plurality of data values associated with the wellbore parameter in the time-domain into time-series data; transforming the time-series data into the concatenated time-series data set of the plurality of data values associated with the wellbore parameter in the time-domain; generating a tubing tally data set; determining at least two data clipping points based on a wellhead location and total depth of the wellbore based on the plurality of data values associated with the wellbore parameter in the time-domain; and clipping the concatenated time-series data set at the at least two data clipping points.

In another aspect combinable with any one of the previous aspects, the operation of generating split data sets from the concatenated time-series data set of the plurality of data values associated with the wellbore parameter includes splitting the concatenated time-series data set at the data clipping point that represents the total depth of the wellbore; generating the downlog of the portion of the plurality of data values associated with the wellbore parameter that occur prior in time to the clipping point that represents the total depth of the wellbore; generating the uplog of the another portion of the plurality of data values associated with the wellbore parameter that occur subsequent in time to the clipping point that represents the total depth of the wellbore; rescaling the downlog and the uplog to match a top and a bottom of the tubing tally data set; and aligning the rescaled downlog and rescaled uplog based on the at least one accelerometer output to generate an initial plurality of data values associated with the wellbore parameter in the depth-domain.

In another aspect combinable with any one of the previous aspects, the operation of applying the locations of the plurality of casing collars to the generated split data sets includes executing a casing collar location detection process to add casing collar locations to the initial plurality of data values associated with the wellbore parameter in the depth-domain; removing false positive casing collar locations from the initial plurality of data values associated with the wellbore parameter in the depth-domain; and applying a depth shift to the initial plurality of data values associated with the wellbore parameter in the depth-domain to generate the plurality of data values associated with the wellbore parameter in the depth-domain.

In another example implementation, an apparatus that includes a tangible, non-transitory computer readable memory that includes instructions operable, when executed by one or more hardware processors, to cause the one or more hardware processors to perform operations including identifying a set of sensed data acquired from one or more sensors of an untethered downhole tool in a time domain as the untethered downhole tool moves through a wellbore between a terranean surface and a particular depth in the wellbore independent of a downhole conveyance, the wellbore including a casing string including a plurality of casing collars, the set of sensed data including a plurality of data values associated with a wellbore parameter in the time-domain, at least one accelerometer output, and locations of the plurality of casing collars; transforming the plurality of data values associated with the wellbore parameter in the time-domain into a plurality of data values associated with the wellbore parameter in a depth-domain based at least in part on the at least one accelerometer output and the locations of the plurality of casing collars; and preparing the plurality of data values associated with the wellbore parameter in the depth-domain for presentation on a graphical user interface (GUI).

In an aspect combinable with the example implementation, the operations include pre-processing the plurality of data values associated with the wellbore parameter in the time-domain.

In another aspect combinable with any one of the previous aspects, the operation of pre-processing includes formatting the plurality of data values associated with the wellbore parameter in the time-domain into a particular file type.

In another aspect combinable with any one of the previous aspects, the operations include identifying a new set of sensed data from the one or more sensors in the untethered downhole tool in the time domain taken during repeated movings of the untethered downhole tool through the wellbore between the terranean surface and the particular depth in the wellbore, each new set of data including a plurality of data values associated the a wellbore parameter in the time-domain and at least one new accelerometer output.

In another aspect combinable with any one of the previous aspects, the operation of transforming includes generating a concatenated time-series data set of the plurality of data values associated with the wellbore parameter in the time-domain from the pre-processed plurality of data values associated with the wellbore parameter in the time-domain; generating split data sets from the concatenated time-series data set of the plurality of data values associated with the wellbore parameter, the split data sets including a downlog of a portion of the plurality of data values associated with the wellbore parameter and an uplog of another portion of the plurality of data values associated with the wellbore parameter; and applying the locations of the plurality of casing collars to the generated split data sets.

In another aspect combinable with any one of the previous aspects, the operation of generating the concatenated time-series data set of the plurality of data values associated with the wellbore parameter in the time-domain includes converting the pre-processed plurality of data values associated with the wellbore parameter in the time-domain into time-series data; transforming the time-series data into the concatenated time-series data set of the plurality of data values associated with the wellbore parameter in the time-domain; generating a tubing tally data set; determining at least two data clipping points based on a wellhead location and total depth of the wellbore based on the plurality of data values associated with the wellbore parameter in the time-domain; and clipping the concatenated time-series data set at the at least two data clipping points.

In another aspect combinable with any one of the previous aspects, the operation of generating split data sets from the concatenated time-series data set of the plurality of data values associated with the wellbore parameter includes splitting the concatenated time-series data set at the data clipping point that represents the total depth of the wellbore; generating the downlog of the portion of the plurality of data values associated with the wellbore parameter that occur prior in time to the clipping point that represents the total depth of the wellbore; generating the uplog of the another portion of the plurality of data values associated with the wellbore parameter that occur subsequent in time to the clipping point that represents the total depth of the wellbore; rescaling the downlog and the uplog to match a top and a bottom of the tubing tally data set, and aligning the rescaled downlog and rescaled uplog based on the at least one accelerometer output to generate an initial plurality of data values associated with the wellbore parameter in the depth-domain.

In another aspect combinable with any one of the previous aspects, the operation of applying the locations of the plurality of casing collars to the generated split data sets includes executing a casing collar location detection process to add casing collar locations to the initial plurality of data values associated with the wellbore parameter in the depth-domain; removing false positive casing collar locations from the initial plurality of data values associated with the wellbore parameter in the depth-domain; and applying a depth shift to the initial plurality of data values associated with the wellbore parameter in the depth-domain to generate the plurality of data values associated with the wellbore parameter in the depth-domain.

Implementations of an untethered downhole tool system according to the present disclosure may include one or more of the following features. For example, an untethered downhole tool system according to the present disclosure can integrate acquired data and wellbore information to generate a depth reference for data taken in a time-domain. As another example, an untethered downhole tool system according to the present disclosure can automate this process and provide a robust surveillance for oil and gas wells through quality control and validation of the data analytics results. Further, an untethered downhole tool system according to the present disclosure can provide this automated process without the need for additional surface or downhole devices. As another example, an untethered downhole tool system according to the present disclosure can indirectly derive depth from time-domain data and validate the derived depth using depth estimations from other sources, such as pressure gradients, temperature gradients, or other logged parameters. As another example, an untethered downhole tool system according to the present disclosure can generate magnetic field data to check or confirm casing collar locator information.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIG. 2A is a chart that shows example data taken by an untethered downhole tool while running through a wellbore according to the present disclosure.

DETAILED DESCRIPTION

Figure 1:
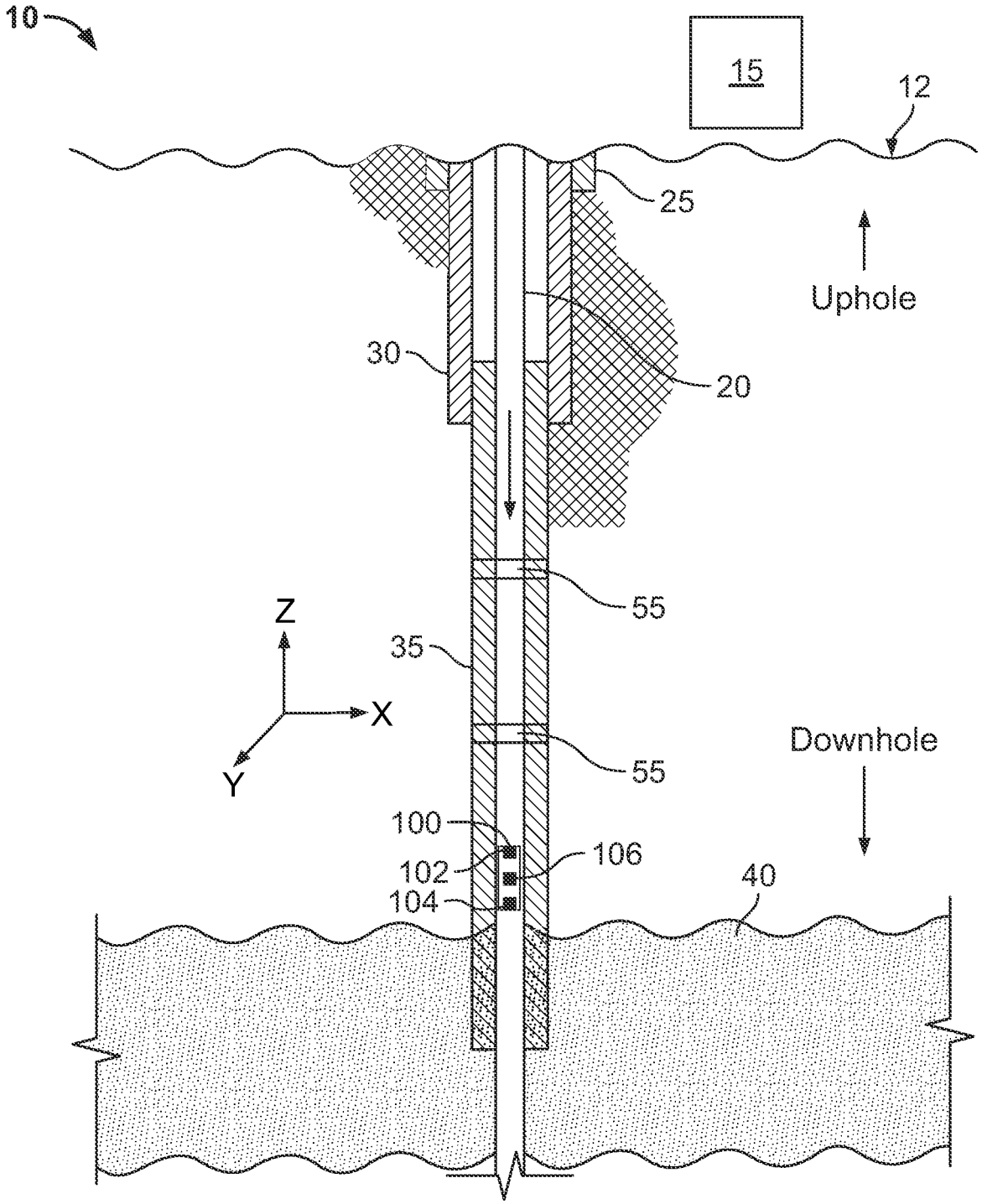
FIG. 1 is a schematic diagram of a wellbore system that includes an example implementation of an untethered downhole tool according to the present disclosure.

FIG. 1 is a schematic diagram of wellbore system 10 that includes an untethered downhole tool 100 according to the present disclosure. Generally, FIG. 1 illustrates a portion of one embodiment of a wellbore system 10 according to the present disclosure in which the downhole tool 100, as an untethered downhole tool 100, may be run into a wellbore 20 and activated during the run in (or run out) process through a wellbore tubular within the wellbore 20. In this example, the downhole tool 100 is untethered in that, during the running in process, the running out process, or during any operations of the downhole tool 100 in the wellbore 20, the downhole tool 100 is disconnected, decoupled, or otherwise unattached from a downhole conveyance, such as a tubular (tubular work string or coiled tubing), wireline, slickline, or other conductor. In some aspects, the untethered downhole tool 100 may be conveyed into the wellbore 20, or out of the wellbore 20 by, for instance, a fluid circulated within the wellbore 20, either alone or in combination with other forces on the untethered downhole tool 100 (for example, gravitational forces, buoyant forces, hydrodynamic forces, or a combination thereof).

In some aspects, the untethered downhole tool 100 comprises a relatively lightweight miniaturized tool (for example, a tool with a size several times smaller than the wellbore diameter). In some aspects, the untethered downhole tool 100 can serve various purposes, such as collecting physical or chemical information regarding the downhole fluids or the borehole including formation rocks and/or tubulars of the wellbore system 10 in a time-domain basis, such as pressure, temperature, depth (or length of the wellbore tubular), casing collar count, and/or geologic data relative to a time (or amount of time) in which the downhole tool 100 is running in or running out of the wellbore 20.

Although shown schematically here, the untethered downhole tool 100 can have a streamlined outer housing in order to, for example, facilitate movement through the wellbore 20 (with a fluid or not). As described in more detail herein, in some aspects, the untethered downhole tool 100 includes one or more accelerometers 102 and/or one or more magnetometers 106. In some aspects, the one or more accelerometers 102 are operable to sense the tool's position with respect to gravity (for example, in two or three dimensions, x, y, and z as shown in FIG. 1) and provide acceleration values (in units of G) to a control system 15. The untethered downhole tool 100 can also include one or more sensors 104 that, for example, are operable to log the wellbore 20 as the tool 100 moves there through. For example, the sensors 104 can include one or more pressure sensors to measure wellbore and/or fluid pressure, one or more temperature sensors, one or more gamma sensors, one or more resistivity sensors, as well as other sensors. The untethered downhole tool 100 can also include a casing collar locator (CCL) 106 that is operable to determine a presence (for example, magnetically or otherwise) of casing collars 55 that, for example, couple joints of a production casing 35 together. The CCL 106, can also detect anomalies and accessories in the well completion, such as perforation interval and packers. The CCL 106, in some aspects, can keep track of a number of casing collars determined as the untethered downhole tool 100 moves downhole (or uphole, or both) and provide such information to the control system 15.

As shown, the wellbore system 10 accesses a subterranean formation 40 and provides access to hydrocarbons located in such subterranean formation 40. In an example implementation of system 10, the system 10 may be used for a production operation in which the hydrocarbons may be produced from the subterranean formation 40 within a wellbore tubular (for example, as a production tubing or otherwise, not shown). However, a wellbore tubular can be any tubular member positioned in the wellbore 20 such as, for example, coiled tubing, any type of casing, a liner or lining, another downhole tool connected to a work string (in other words, multiple tubulars threaded together), or other form of tubular member.

A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Any of the illustrated casings, as well as other casings or tubulars that may be present in the wellbore system 10, may include one or more casing collars 55 (as shown in FIG. 1).

As shown, the untethered downhole tool 100 may be run into the wellbore 20. In some aspects, as shown, the untethered downhole tool 100 may be inserted into the wellbore 20, which may be filled with a fluid, such as a drilling fluid or otherwise. In such aspects, the untethered downhole tool 100 may be oriented and weighted to move downhole from the terranean surface 12 and toward the subterranean formation 40 through the wellbore fluid.

In some aspects, the wellbore fluid is not static in the wellbore 20 but is a circulated (for example, pumped) wellbore fluid 50 that dynamically moves the untethered downhole tool 100 through the wellbore 20. Thus, in some aspects, the untethered downhole tool 100 is moved through the wellbore 20 in a fluid (either static or dynamic) without being connected to any other form of downhole conveyance, such as a working string or downhole conductor (for example, wireline or slickline or other conductor).

The illustrated control system 15 can be located at the terranean surface 12 or can also be integral with the untethered downhole tool 100. In some aspects, the control system 15 can represent a micro-processors based control system that includes one or more hardware processors, one or more memory modules (for example, non-transitory computer readable media), and instructions stored on the one or more memory modules that can be executed by the one or more hardware processors to perform operations.

In some aspects, the control system 15 can execute an automated workflow using data analytics and machine learning to determine depth-domain logging data from time-domain logging data taken by the untethered downhole tool 100 as it is run into (downhole) and run out of (uphole) the wellbore 20. Although the present disclosure provides examples of particular types of logged data (for example, pressure and temperature), the processes described herein can be applied to any other data package where recording starts and ends at the terranean surface 12 with the untethered downhole tool 100 by, for instance, a manual switch (on/off) of the sensors 104 or based on an automatic switching on of the sensors 104 (for example, to satisfy a specific condition, such as temperature, pressure, time, or otherwise). Once time-domain data has been collected by the sensors, in other words, logged data vs. time, an automated depth correlation process performed by the control system 15 can process the data to generate depth-domain data (in other words, logged data vs. wellbore depth).

Such processing, as described in more detail here, can include sequentially and intuitively generating parameters to clean and prepare the time-domain data. This can include clipping non-required portions of the time-domain data (for example, data taken during a surface idle condition). This processing can also include detecting a time index of a wellbore bottom position where the untethered downhole tool 100 reaches a total depth of the wellbore 20 based on, for example, recorded data such as pressure, temperature, magnetometer and accelerometer data, and/or other data. The processing can also include preparing split data sets of downlog (data collected as the untethered downhole tool 100 moves downhole) and uplog data (data collected as the untethered downhole tool 100 moves uphole).

Example data collected for the downlog and uplog data sets by the untethered downhole tool 100 is shown in Table 200 of FIG. 2A. Table 200 shows rows that include: sensor (in other words, sensed data) 205, unit of measure ("unit") 207, type 209, and sampling rate 211. Table 200 also shows columns that include: channel name 202, low resolution time 204, temperature 206, pressure 208, corrected temperature 210, high resolution time (T2) 212, x-magnetometer ($B_x$) 214, y-magnetometer ($B_y$) 216, z-magnetometer ($B_z$) 218. In some aspects, sensors 104 can collect the data shown in columns 204-212, accelerometers 102 ($A_x$, $A_y$, and $A_z$, not shown in FIG. 2A), and magnetometers 106 ($B_x$, $B_y$, $B_z$) can collect the data shown in columns 214-218. The input tally data is shown in column 220. In some aspects, only one axis data, such as z-magnetometer data ($B_z$) 218, can be used in a data set.

Figure 3A:
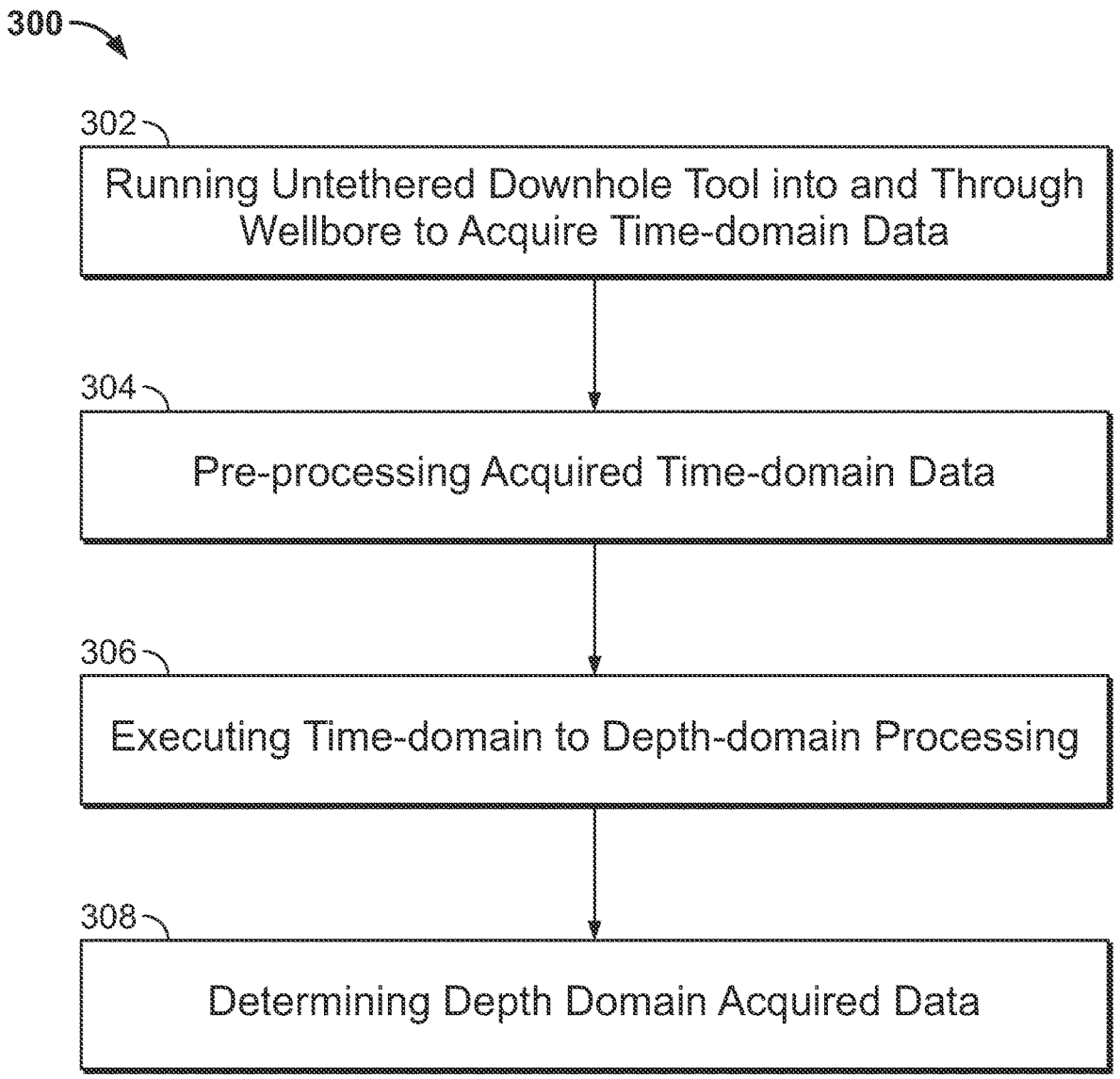
FIGS. 3A-3B are flowcharts that illustrate example methods performed with or by an untethered downhole tool system according to the present disclosure.

FIG. 3A is a flowchart that illustrates an example method 300 performed with or by an untethered downhole tool system, such as the untethered downhole tool 100 and control system 15 shown in FIG. 1. Method 300 can start at step 302, which includes running untethered downhole tool into and through wellbore to acquire time-domain data. In some aspects, prior to step 302, the untethered downhole tool 100 is powered up, its parameters checked, and a conveyance mechanism is loaded. The sensors 104, for example, read atmospheric pressure and surface temperature. The magnetometers 106 and accelerometers 102 can show an initial activity during testing and preparation, which usually happens away from the wellhead of wellbore 20. Then the untethered downhole tool 100 is dropped into the wellbore 20 and a well cap is sealed. There can be a slight increase in pressure due to opening the crown valve of the wellbore 20.

The sensed pressure increases to SWHP as soon as a master valve of the wellbore 20 is opened. There can be a standby time during which a pressure sensor 104 is exposed to well condition, however temperature and magnetometer (or accelerometers) sensors can indicate that the untethered downhole tool 100 is stationary. This can correspond to a required valve operation to allow enough room for the untethered downhole tool 100 to start the downward journey.

During the journey, as the untethered downhole tool 100 moves through the wellbore 20, sensors 104 can collect sensor data, such as pressure and temperature data (or other logging data based on the type of sensors 104 included within the untethered downhole tool 100). The data collected by the sensors 104 is in a time-domain (according to an internal clock of the untethered downhole tool 100), such as temperature vs. time, pressure vs. time, as the untethered downhole tool 100 moves through the wellbore 20 (downhole and then uphole), or while stationary for any reason (stationary measurements, tool stuck, tool waiting to be deployed or retrieved). Other data can be collected in step 302. For example, magnetic field data or acceleration data can be collected (for example, in the z-direction or all three of x, y, and z-directions) by the sensor 102. Like the sensor data, the collected magnetometer or acceleration data is in the time-domain. Also, casing collar location data can be determined (for example, magnetically) by the CCL 106. The casing collar location data can include specific casing collar locations in the time-domain as well.

As the journey can include both a downhole and an uphole portion, as one of the set conditions is met to trigger the return journey, the mirror profile of response of sensors 104 can begin. For example, a temperature set parameter can be met, hence the untethered downhole tool 100 successfully changes direction and starts to float back to the terranean surface. This position can be the bottom log interval (BLI). It can be the total depth of the wellbore 20 or any desired depth to start the log-up process of the untethered downhole tool 100. If the untethered downhole tool 100 is programmed to reach the bottom of the wellbore 20, then pressure and temperature at this event represents static bottom hole pressure (SBHP) and static bottom hole temperature (SBHT), respectively. These conditions can be considered in the pre-job planning as they can contribute to the success of the journey and data acquisition.

Once the untethered downhole tool 100 completes its uphole journey, the untethered downhole tool 100 is standing by below the master valve, waiting to be retrieved. The magnetometers 106 show no movement of the untethered downhole tool 100. Also, sensed pressure and temperature returns back to the initial values before the downhole journey. The difference in logging speed can be clearly noticeable in time between downlog and uplog. The downhole movement can be relatively slower due to buoyancy and friction. This feature can be an important quality control of sensor data, in other words, repeatability at different speeds and potentially sensor positions in the wellbore 20. The end of the uphole journey can also mark the total mission time that is used in pre-job planning. Hence, it can be a good practice to compare the expected values with the actual values. A safety factor can be applied to the mission time in order to account for any intermittent stick and slip, or stuck situation. Techniques to detect the untethered downhole tool 100 below the master valve before departure and after arrival can be added for more operational optimization.

At the terranean surface, the master valve can be opened to let the untethered downhole tool 100 go below the crown valve. Once the master valve is closed and the crown valve is opened, pressure is relieved from the bleed nose on the cap; hence, the recorded pressure drops to atmospheric at the sensors 104. This movement can also be well captured by the magnetometers 106 and reflected in the tri-axial responses. As soon as the untethered downhole tool 100 is retrieved and cleaned and the power is switched off to save the battery life awaiting for data retrieval.

Figure 2B:
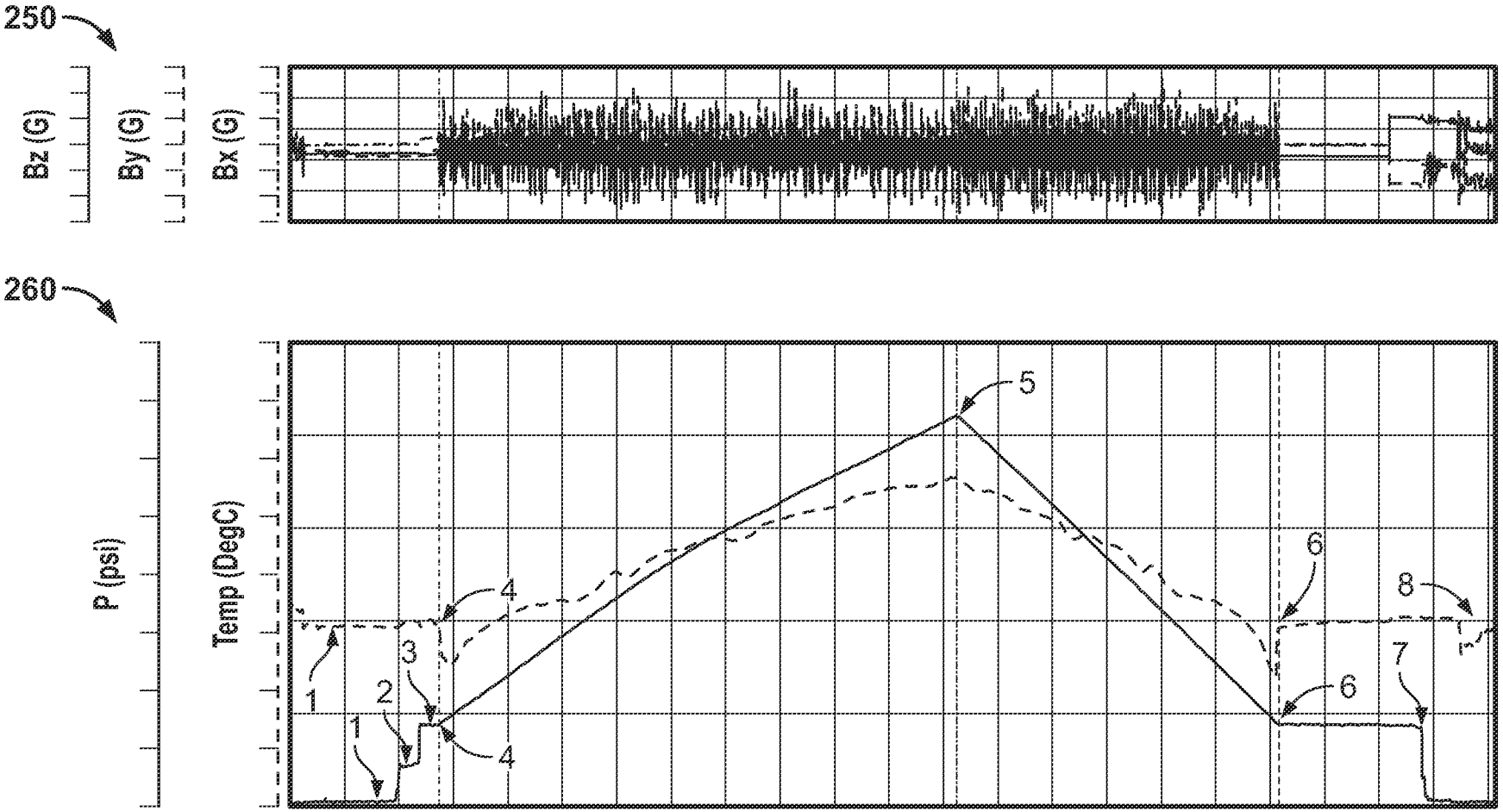
FIG. 2B illustrates logs of example data taken by an untethered downhole tool, showing notable points during the running in and running out trips according to the present disclosure.

FIG. 2B shows a graph 250 of magnetometer data ($B_x$, $B_y$, $B_z$) and a graph 260 of temperature and pressure data taken in an example trip of the untethered downhole tool 100 in step 302. Circled points 1-8 refer to specific occurrences in the journey—and pressure and temperature measurements taken during such occurrences—that the untethered downhole tool 100 takes downhole and then back uphole. For example, point 1 refers to tool power up and parameter check. Point 2 refers to tool drop and sealing of the well cap. Point 3 refers to the opening of the master valve. Point 4 refers to initial downhole movement of tool. Point 5 refers to the beginning of the uphole movement of the tool. Point 6 refers to the tool just below the master valve at the end of the uphole movement. Point 7 refers to the re-opening of the master valve. Point 8 refers to power switch off of the tool as it is removed from the well.

In some aspects, step 302 can be performed multiple times (for example, multiple trips of the untethered downhole tool 100 through the wellbore 20) prior to continuing to step 304. Thus, in some aspects, the collected sensor data can include several sets of collected sensor data in the time-domain, which can be used for quality control purposes or otherwise.

Method 300 can continue at step 304, which includes pre-processing the acquired time-domain data. For example, in some aspects, the raw, collected data (from sensors 104 or otherwise) in step 302 is pre-processed for preparation of further analysis. In some aspects, step 304 can include formatting the collected data into, for instance, certain file types (such as csv files or otherwise). The formatting can ensure, for example, that the channel naming, data type, sampling rates and other criteria (for example, as shown in Table 200) are meeting preset parameters of the rest of method 300.

In some aspects, step 304 can also include preparing and loading (along with the data into particular file types), codes and libraries (with the control system 15) for efficient processing of the collected data. For example, python codes using multiple libraries can be loaded in order to optimize and speed up the process. As another example, MATLAB codes and libraries can be loaded and used for the further processing as described in method 300.

Method 300 can continue at step 306, which includes executing time-domain to depth-domain processing. For example, in step 306, the collected time-domain sensor data (from sensors 104) is processed into depth-domain sensor data to provide sensor data relative to wellbore depth of wellbore 20. Thus, the untethered downhole tool 100, which collects data in the time domain as it moves through the wellbore 20, can also be used to determine depth-domain data, in some cases, more efficiently than downhole logging tools that conventionally collect data in the depth-domain but require a downhole conveyance (for example, wireline or otherwise).

Step 306, generally, includes properly and accurately converting a time stamp into depth for meaningful and useable data. In the depth calculation workflow of step 306, a dataset is created using two subsets of the recorded data. If a well is logged multiple times, each run data can be handled separately for processing purpose and then compared (for example, for quality control purposes). The outcome of this workflow in step 306 is two subsets of data that each correspond to a different resolution. These logs are depth-matched to each other at a first step and then correlated to the reference depth measurement. Log stretching and compression due to uneven motion of the untethered downhole tool 100 can be corrected using, for example, predefined collars location according to a tubing tally. This effect can also be corrected with the use of accelerometer data. This can allow a proper speed correction of the data prior to depth matching.

Figure 3B:
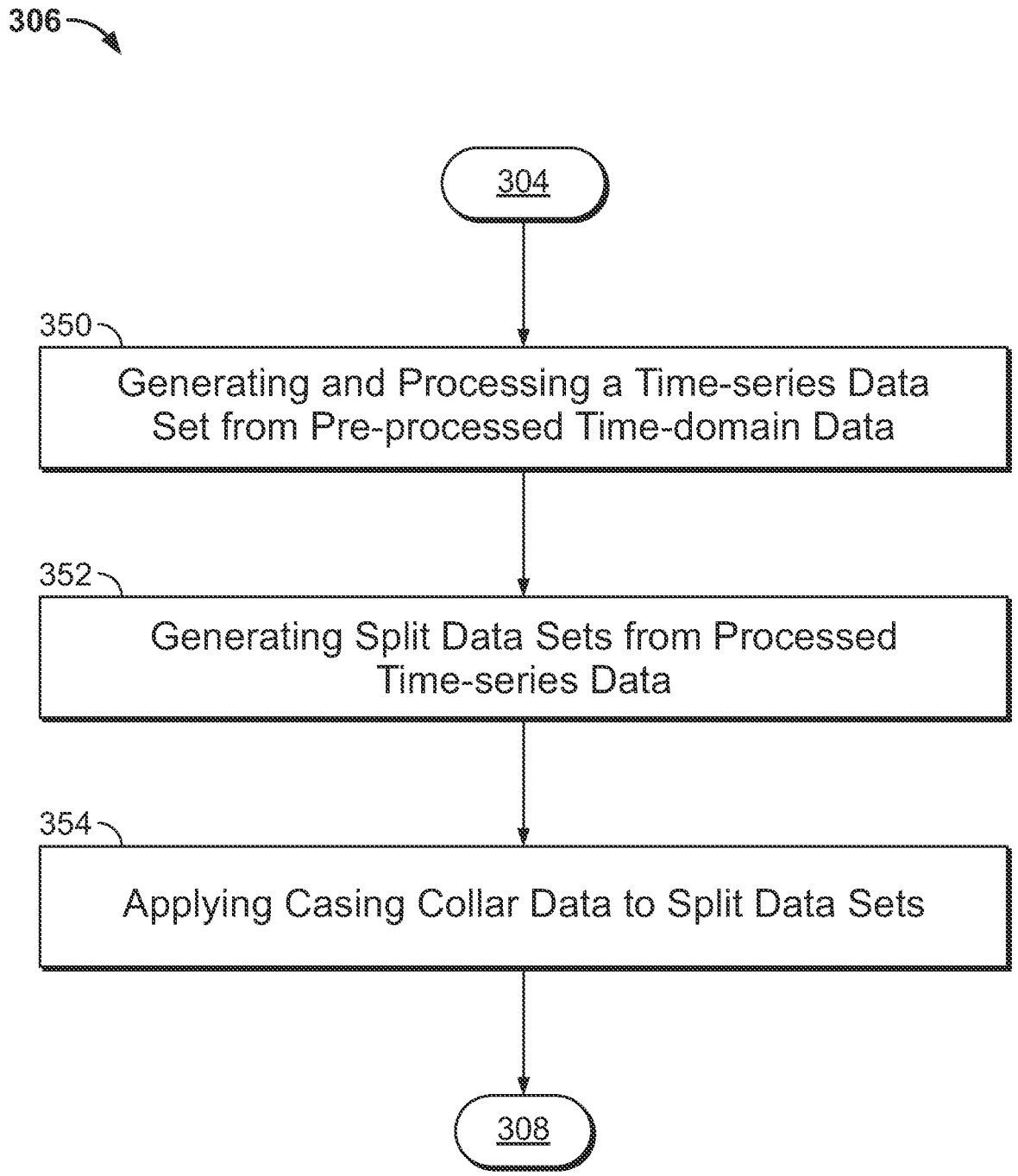

Step 306 can be implemented with sub-steps shown in FIG. 3B. For example, step 306 can include sub-step 350, which includes generating and processing a time-series data set from pre-processed time-domain data. For example, at the conclusion of step 304, pre-processed time-domain data from the sensors 104 is generated. However, such pre-processed time-domain data may require further processing or correction in consideration that, for example, the pre-processed time-domain data includes both downlog and uplog data (with the downhole and uphole trips of the untethered downhole tool 100 taking different time periods due to irregular motion and speed).

Sub-step 350 can include converting the pre-processed time-domain data into time-series data. For example, as described, the collected data from sensors 104 can be recorded using an internal circuit clock to the untethered downhole tool 100. By converting the pre-processed time-domain data into time-series data, a first data point collected (for example, for pressure, temperature, or other sensed parameter) is assigned a time stamp of 0 seconds. All further collected data points for each logged parameter is also assigned a time stamp. Thus, at any particular time stamp, there can be several collected data points of log data assigned thereto.

Sub-step 350 can also include concatenating the sensed data (from sensors 104) as well as the accelerometer data (from 102) and/or magnetometer (from 106) into a single data set. For example, in some aspects, any sensor or accelerometer data that is formatted and integrated from different sensors with different sampling rates can be concatenated to produce one data set. This can be useful in that subsequent steps within the workflow can be applied to a single concatenated data set in an optimized way. Also, a single concatenated data set can provide a technique to compare and correlate data since all data can be referenced to the same time reference.

Sub-step 350 can also include creating a tubing tally data set. The tubing tally set, generally, refers to a tally of tubing joints (for example, casing joints) passed by the untethered downhole tool 100 as it moves through the wellbore 20 (downhole and then uphole). In some aspects, this data set is generated from a pre-programmed or pre-determined tubing tally drawing or from a tally table that is crated according to the construction of the casings within the wellbore 20.

Sub-step 350 can also include detecting data clipping points from the concatenated data set. For example, clipping points for the data set can include a location at an uphole end, or top, of the wellbore 20, as well as a location at a downhole end, or bottom, of the wellbore 20. By detecting and/or setting these locations (and others if desired) as clipping points, unusable or unnecessary data within the concatenated data set can be removed. For example, data collected from the untethered downhole tool 100 between initial power on of the sensors 104 and a time at which the untethered downhole tool 100 reads valid data below a well head of the wellbore 20 could be removed by setting such clipping points as the top of the wellbore 20.

Figure 4:
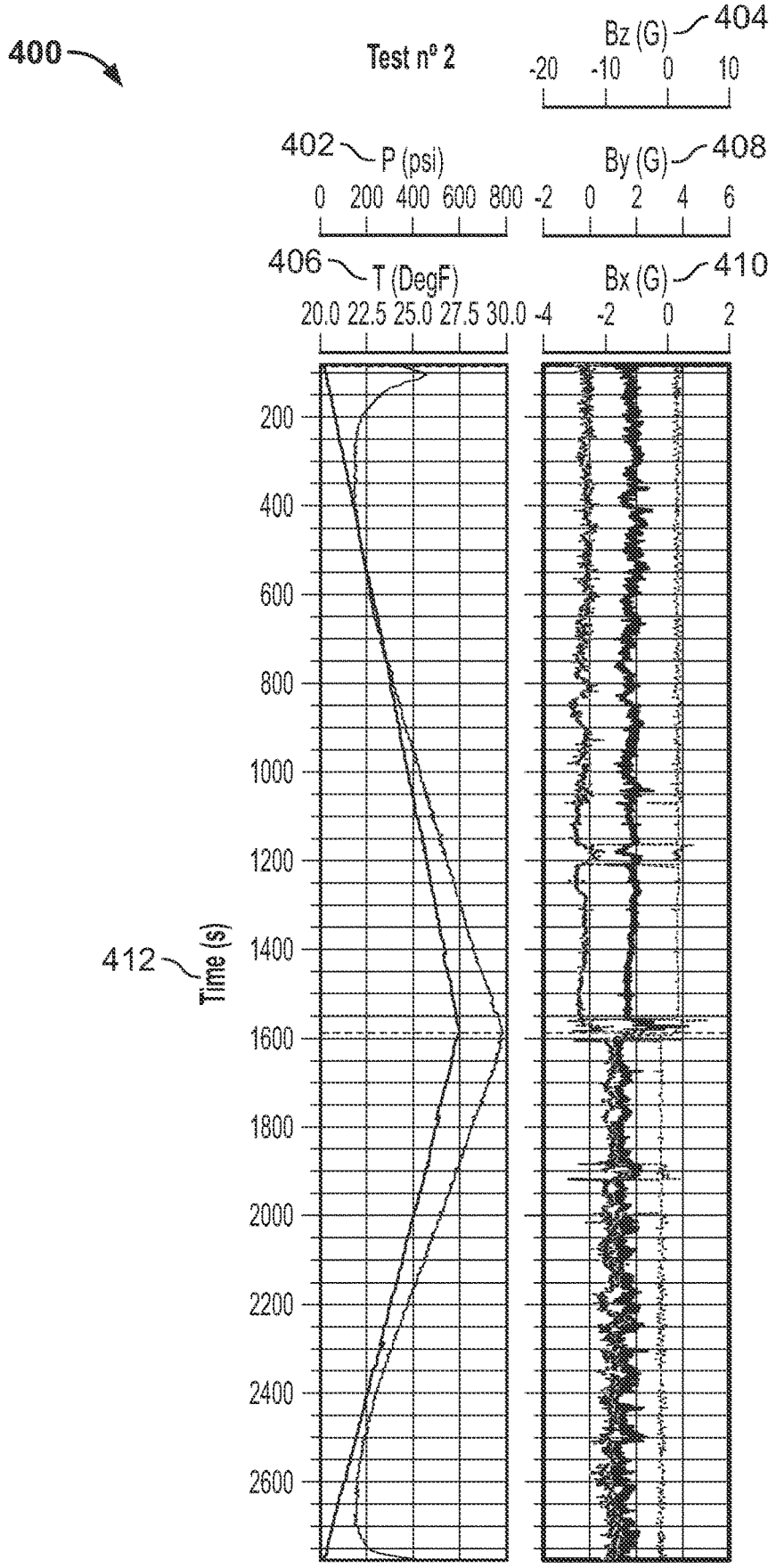
FIGS. 4-10 are logs of data taken by an untethered downhole tool, or logs of data that has been processed from data taken by an untethered downhole tool according to the present disclosure.

Sub-step 350 can also include plotting a full, raw data set (with clipping points) for quality control. An example of a set of full, raw data can be seen FIG. 4, which shows graph 400. Graph 400 shows pressure 402, z-magnetometer 404, temperature 406, y-magnetometer 408, and x-magnetometer 410 in a time-domain set relative to time 412 (0-7200 seconds). The clipping points are shown in the graph 400 as dashed lines at certain times.

Figure 5:
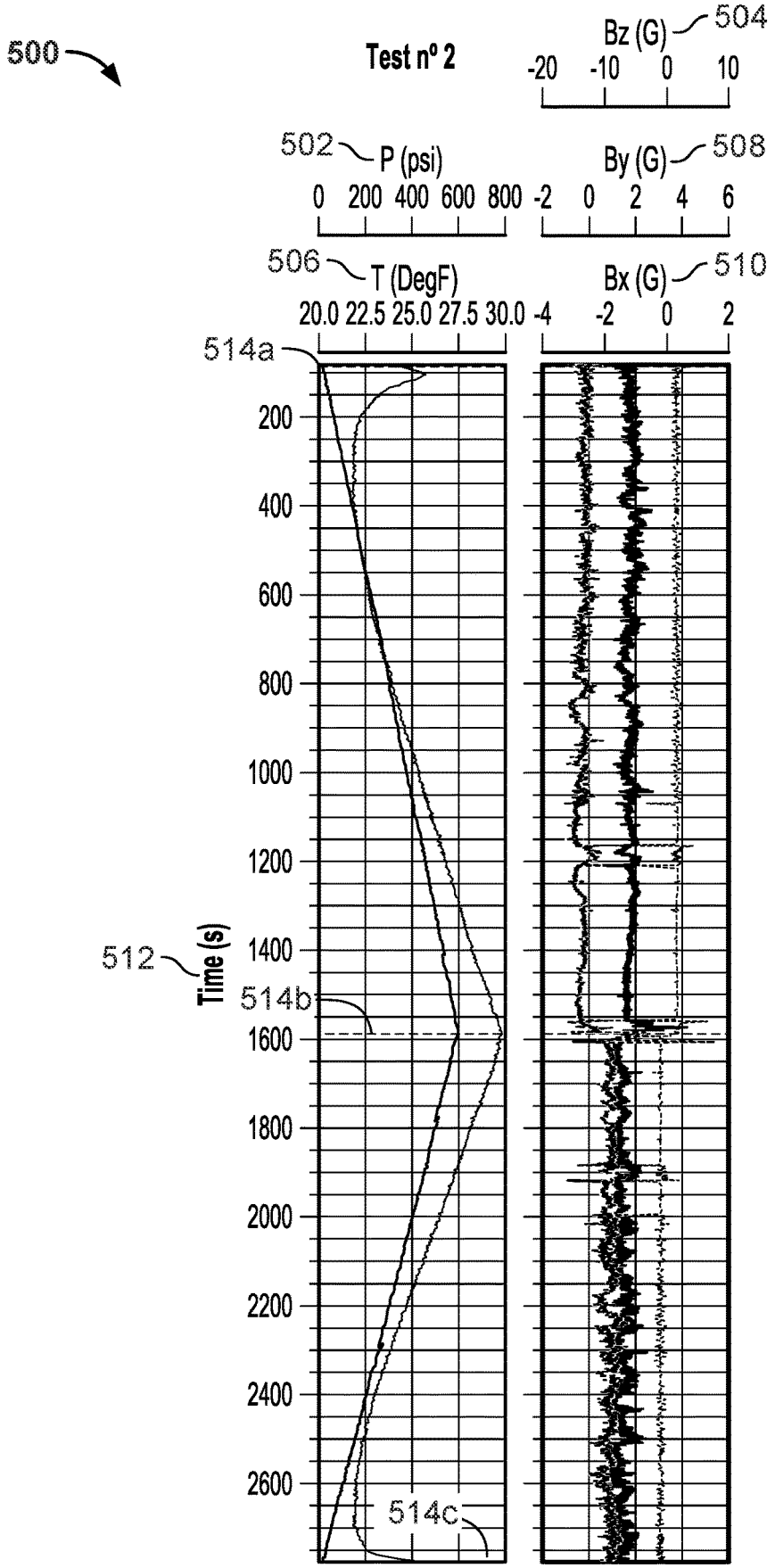

Sub-step 350 can also include clipping the data set (with the determined clipping points) and replotting a log of the sensed data within the clipping points. For example, as shown in FIG. 5, graph 500 shows plots of the clipped data. Graph 500 shows pressure 502, z-magnetometer 504, temperature 506, y-magnetometer 508, and x-magnetometer 510 in a time-domain set relative to time 512 (0-2800 seconds). The clipping points are shown in the graph 500 as dashed lines at certain times. As shown, the first clipping point 514*a* represents an uphole, top of the wellbore 20. A second clipping point 514*b* represents a downhole, bottom of the wellbore 20. A third clipping point 514*c* represents the top of the wellbore 20 as the untethered tool 100 returns back to surface. These time stamps are calculated and assigned based on the collected data. Machine learning algorithms uses simple calculations to detect the region where these events are located in time, also uses learning algorithms to fine-tune their locations. This step can be used to ensure that only clean data goes to the next step.

Sub-step 350 can continue to sub-step 352, which includes generating split data sets from processed time-series data. For example, as described, the data collected by the untethered downhole tool 100 represents data taken during a trip downhole in the wellbore 20, as well as a trip uphole in the wellbore 20. Therefore, in some aspects, there can be two points of collected data (for every logged parameter) at any particular depth of the wellbore: one collected point on the downhole trip, and one collected point on the uphole trip. Further, if the untethered downhole tool 100 makes several trips within the wellbore 20 (for example, several iterations of step 302), there can be more than two points of collected data (for every logged parameter) at any particular depth of the wellbore. Determining which collected data points are attributable to a downhole trip, and which collected data points are attributable to an uphole trip can be part of the workflow.

Sub-step 352, therefore, can include splitting the data (from graph 500) into a downlog and an uplog based on total depth as a clipping point. Total depth represents the point within the wellbore 20 in which the untethered downhole tool 100 has completed its downhole trip and starts the uphole trip within the wellbore 20. The total depth clipping point is shown as clipping point 514*b* on graph 500.

Figure 6:
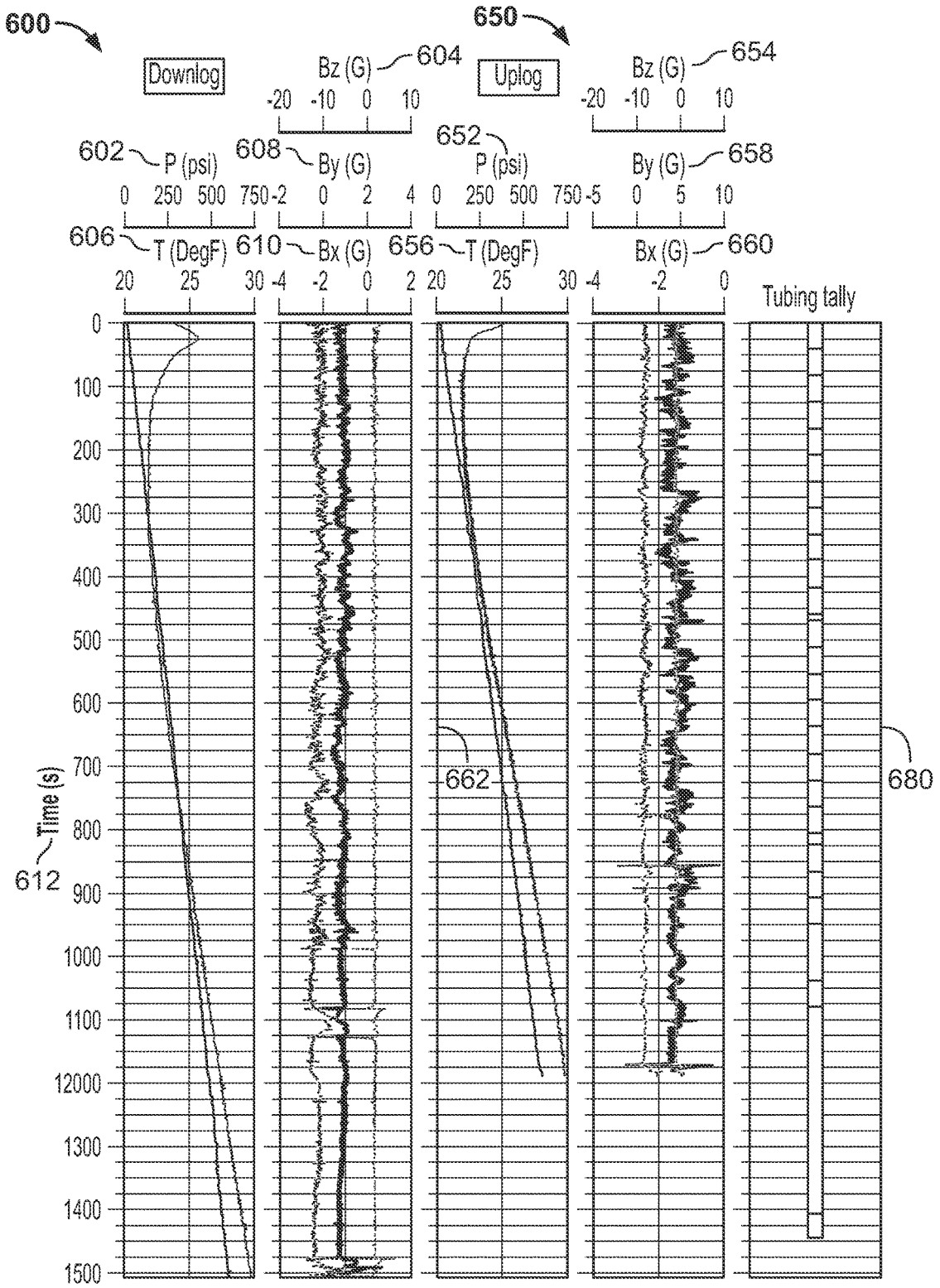

Sub-step 352 can also include generating a downlog plot and an uplog plot using the total depth as the clipping point. For example, FIG. 6 shows a downlog graph 600 and an uplog graph 650. Downlog graph 600 shows pressure 602, z-magnetometer 604, temperature 606, y-magnetometer 608, and x-magnetometer 610 in a time-domain set relative to time 612 (0-1500 seconds). Uplog graph 650 shows pressure 652, z-magnetometer 654, temperature 656, y-magnetometer 658, and x-magnetometer 660 in a time-domain set relative to time 662 (1500 to about 2700 seconds). As also shown in FIG. 6, a tubing tally plot 680 is also included (for example, as determined in sub-step 350).

Sub-step 352 can also include rescaling the data to match a top and a bottom of the tubing tally. In some aspects, the matching of the top and bottom according to the tubing tally occurs due to the different time durations for the downhole trip of the untethered downhole tool 100 relative to the uphole trip of the untethered downhole tool 100. For instance, despite the traveled distance of the untethered downhole tool 100 in the uphole trip being equal to the traveled distance in the downhole trip, the untethered downhole tool 100 travels downward and upward at different speeds and movement. This can produce different sizes of time driven data for the downlog versus the uplog. In order to compare, correlate, and integrate data from both the uplog and the downlog, data is stretched or compressed in time to align detected events (between the top and bottom of the wellbore 20).

Figure 7:
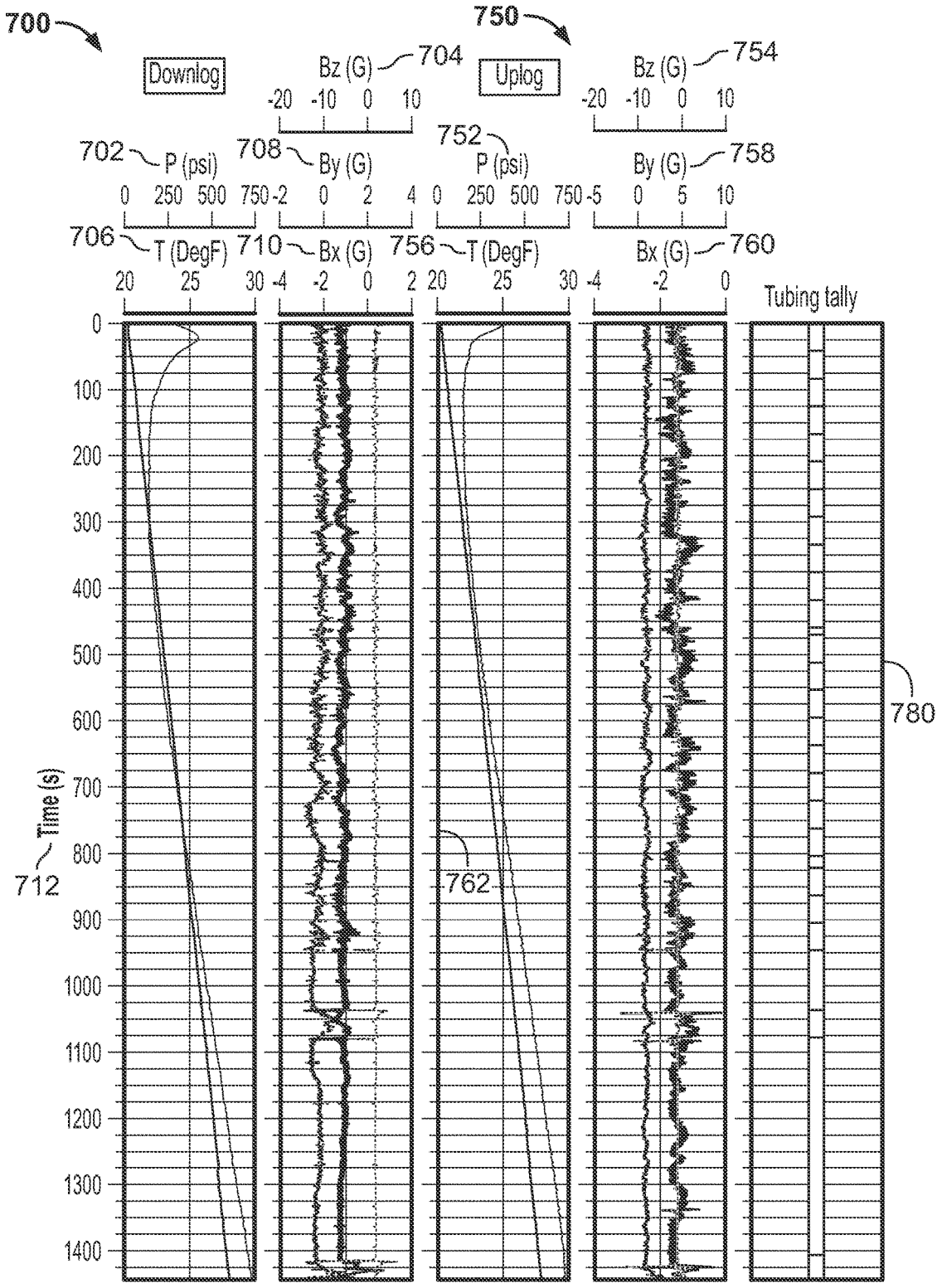

For example, as shown in FIG. 7, the downlog graph and uplog graph of FIG. 6 is time matched to the tubing tally. This can be achieved by resampling all acquired data to the longest dataset (in this case, the downlog is the slowest). The tubing tally, which is a depth driven data, is plotted for quality control and referenced to the downlog time reference. FIG. 7 illustrates a downlog graph 700 and an uplog graph 750. Downlog graph 700 shows pressure 702, z-magnetometer 704, temperature 706, y-magnetometer 708, and x-magnetometer 710 in a time-domain set relative to time 712 (0-1500 seconds). Uplog graph 750 shows pressure 752, z-magnetometer 754, temperature 756, y-magnetometer 758, and x-magnetometer 760 in a time-domain set relative to time 762 (1500 to about 3000 seconds). As also shown in FIG. 7, the tubing tally plot 780 is also included.

Sub-step 352 can also include filtering and aligning the data with the accelerometer and/or magnetometer sensed data. For example, the CCL 106 in the untethered downhole tool 100 uses, for instance, magnetic detection techniques to determine the locations of the casing collars 55 in the wellbore 20. Filtering can remove noise and improves the signal-to-noise ratio of the magnetic field data from the CCL 106. Since collars are detected as peaks in the magnetic data, filtering can remove the fake peaks that do not correspond to collars 55 in the data.

In some aspects, therefore, the downlog and uplog can be correlated to the reference tubing tally using the magnetometer data. Further, the casing collar location data can further be improved using all six channels from, for example, the tri-axial magnetometer in both down and up directions.

Figure 8:
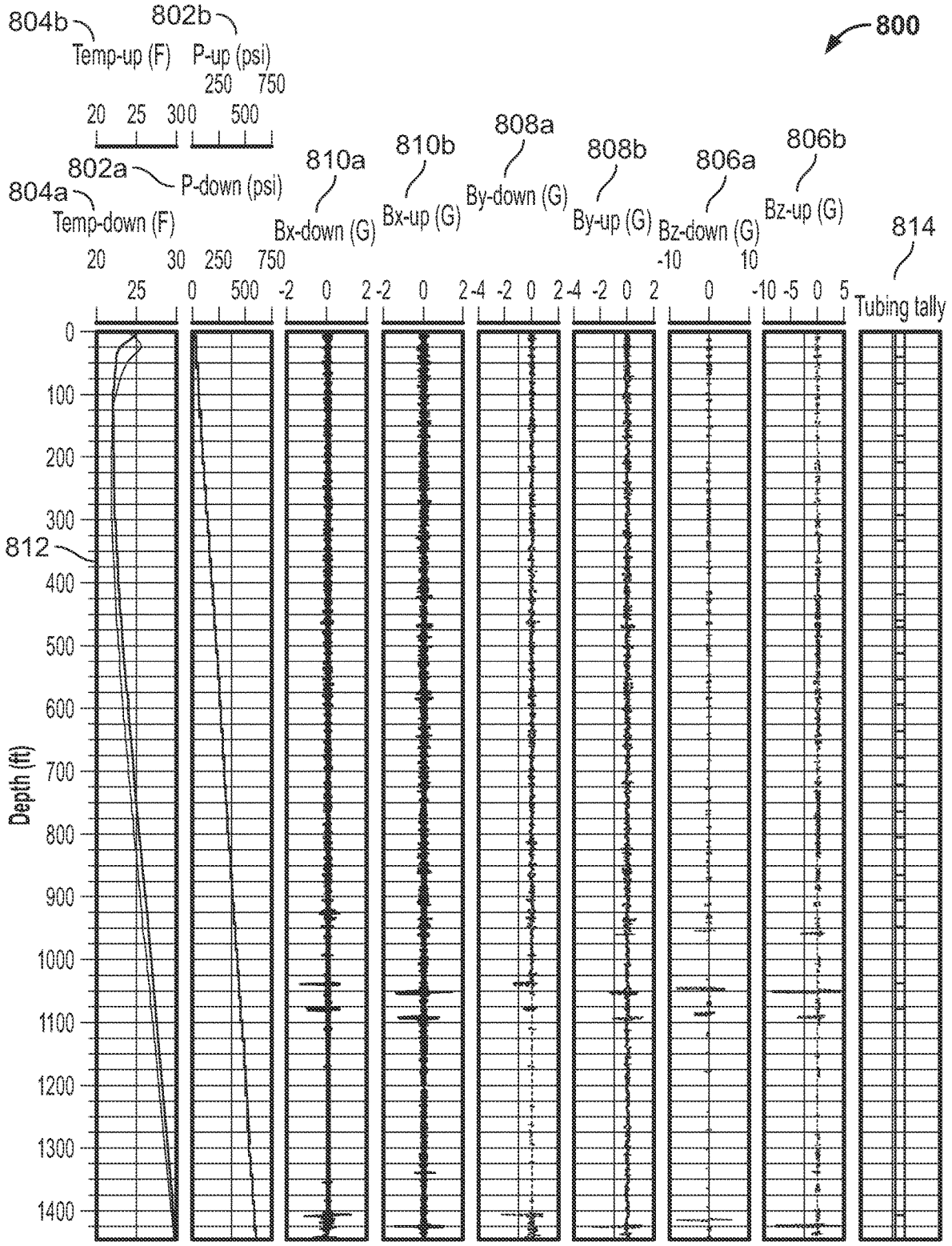

Sub-step 352 can also include, once the filtering has occurred, plotting the data in a depth-domain that has been processed according to sub-step 352. For example, as shown in FIG. 8, graph 800 illustrates downlog pressure 802*a* and uplog pressure 802*b*, downlog temperature 804*a* and uplog temperature 804*b*, downlog z-magnetometer 806*a* and uplog z-magnetometer 806*b*, downlog y-magnetometer 808*a* and uplog y-magnetometer 808*b*, and downlog x-magnetometer 810*a* and uplog x-magnetometer 810*b*. These parameters are plotted in depth-domain relative to wellbore depth 812 (in feet). As also shown in FIG. 8, the tubing tally plot 814 is also included.

In some aspects, time-domain data (logs) can be converted to depth-domain data (logs) using one or a combination of the following techniques. For example, conversion can be done based on pressure gradient. In this technique, pressure gradient from both down and uplogs is used to convert time to depth using a known, wellbore fluid density. This qualitative approach can be performed prior to a full processing and final depth conversion. Also the pressure gradient technique can be used as a good quality control to assess the untethered downhole tool mission success. Anomalies can be spotted quite easily across zones where pressure gradient comes off the expected range of the fluid column.

The derived depth, D, is calculated using the surface wellhead pressure (SWHP) and static bottom hole pressure (SBHP) (for example, shown as pressures in points 4 and 5, respectively in FIG. 2B). Here, with a hydrostatic pressure (HP):

$$\text{SBHP}=\text{SWHP}+HP \quad \text{Eq. 1.}$$

$$HP=\rho g D \quad \text{Eq. 2.}$$

Hence, $$D=(\text{SBHP}-\text{SWHP})/(\rho g) \quad \text{Eq. 3.}$$

In Eqs. 1-3, ρ is the wellbore fluid density, g is acceleration due to gravity, and D is true vertical depth (TVD) (in other words, derived depth).

Sub-step 352 can continue to sub-step 354, which includes time-to-depth conversion using one or a combination of techniques such as casing collar data from the split (downlog and uplog) data sets and tubing tally. For example, in some aspects, the casing collar location data (for example, from CCL 106) can be used to correct or ensure that the depth domain plots are correct, in other words, that the sensed data (for example, pressure, temperature, or other logged parameter) is correctly aligned with the depth at which it has been sensed (by sensors 104).

Sub-step 354 can include executing a CCL detection algorithm. For example, in some aspects, the data collected by the CCL 106 can be used in a CCL detection algorithm to determine (with high confidence) the actual depth locations of the casing collars 55. For example, one CCL detection algorithm that can be executed by control system 15 can an algorithm that uses peak detection on each of the six sets of data (both downlog and uplog data from the x, y, and z-magnetometers). Confidence level in a peak detection is assigned if the same peak is detected in most of the six sets of data. In some aspects, more weight assigned to the vertical axis ($B_z$-uplog and $B_z$-downlog) as the z-magnetometer can be more sensitive to casing collars.

Another example CCL detection algorithm combines all the six accelerometer data sets into one that eliminates all the noise, and the detected peaks correspond to casing collars. The confidence in collar detection can use the data value at the peak and the relative time/distance to the next detected peak.

Another example CCL detection algorithm starts with the first peak (for example, at a wellhead) and assigns a high confidence. Then, the algorithm fetches for the next peak from all six accelerometer data sets (or the combined one) at a specific gate that corresponds to a length of the first casing joint (for example, with a joint length of 40 ft., an untethered downhole tool speed of about 40 ft/min., then the gate opens after 60 seconds of data plus or minus a 5 second tolerance). If multiple peaks are detected within the window, then the highest confidence detected peak is assigned as the casing collar of the first joint. This is repeated until the last detected casing collar.

In some aspects, one or more of the example CCL detection algorithms can use one or more machine-learning techniques or neural network algorithms. For example, long short-term memory (LSTM) neural networks or recurrent neural networks (RNN) can be used in one or more of the example CCL detection algorithms.

Figure 9:
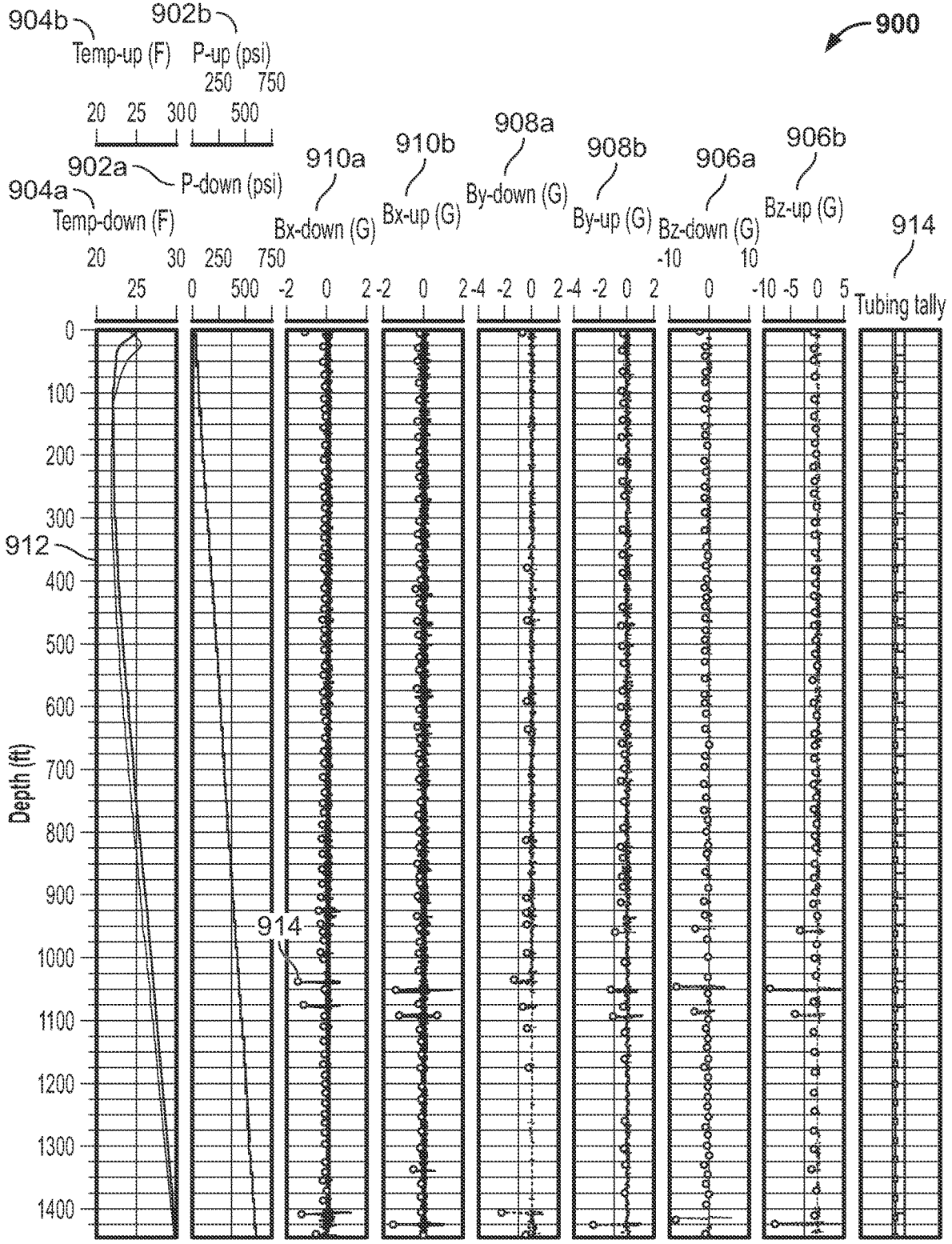

Sub-step 354 can also include plotting the depth domain data from sub-step 352 (graph 800) with the casing collar locations identified in the data. For example, as shown in FIG. 9, graph 900 illustrates downlog pressure 902*a* and uplog pressure 902*b*, downlog temperature 904*a* and uplog temperature 904*b*, downlog z-magnetometer 906*a* and uplog z-magnetometer 906*b*, downlog y-magnetometer 908*a* and uplog y-magnetometer 908*b*, and downlog x-magnetometer 910*a* and uplog x-magnetometer 910*b*. These parameters are plotted in depth-domain relative to wellbore depth 912 (in feet). In some aspects, the data shown in graph 900 is the same as that shown in graph 800.

In graph 900, however, casing collar locations are identified by points superimposed on the data plots, as shown by example labeled location point 914 (only one casing collar location point labeled for simplicity).

The casing collar location points 914 can be determined by the CCL detection algorithm. In some examples, therefore, the casing collar location points 914 represent detected peaks in each of the six accelerometer data channels (as shown in graph 900). If, according to the detection algorithm, the detected peaks have a confidence level that is sufficient, then the detected peaks can be interpreted as casing collars.

As shown in graph 900, casing collar location points 914 are overlaid on the magnetometer data 906*a-b*, 908*a-b*, and 910*a-b*. By overlaying the detected peaks (as casing collar locations) with the magnetometer data, some quality control can be achieved.

Sub-step 354 can also include executing a classification algorithm to determine any false positive peaks in the CCL detection algorithm. For example, false positives are detected magnetic data peaks that are not casing collars. Such false positives can be removed by the classification algorithm in order to obtain a proper correlation of casing collars to tubing tally, for example, in order to produce an accurate depth conversion. The classification algorithm can include, for example, a supervised learning algorithm such as decision trees, SVM, logistic regression, or random forest.

Sub-step 354 can continue to step 308, which includes determining depth domain acquired data. For example, in some aspects, the depth domain data can be represented by graph 800 that is generated subsequent to sub-step 352. However, in some aspects, the depth domain data of graph 800 has not been corrected according to the CCL detection algorithms, in other words, according to a correlation of casing collar locations and tubing tally.

Figure 10:
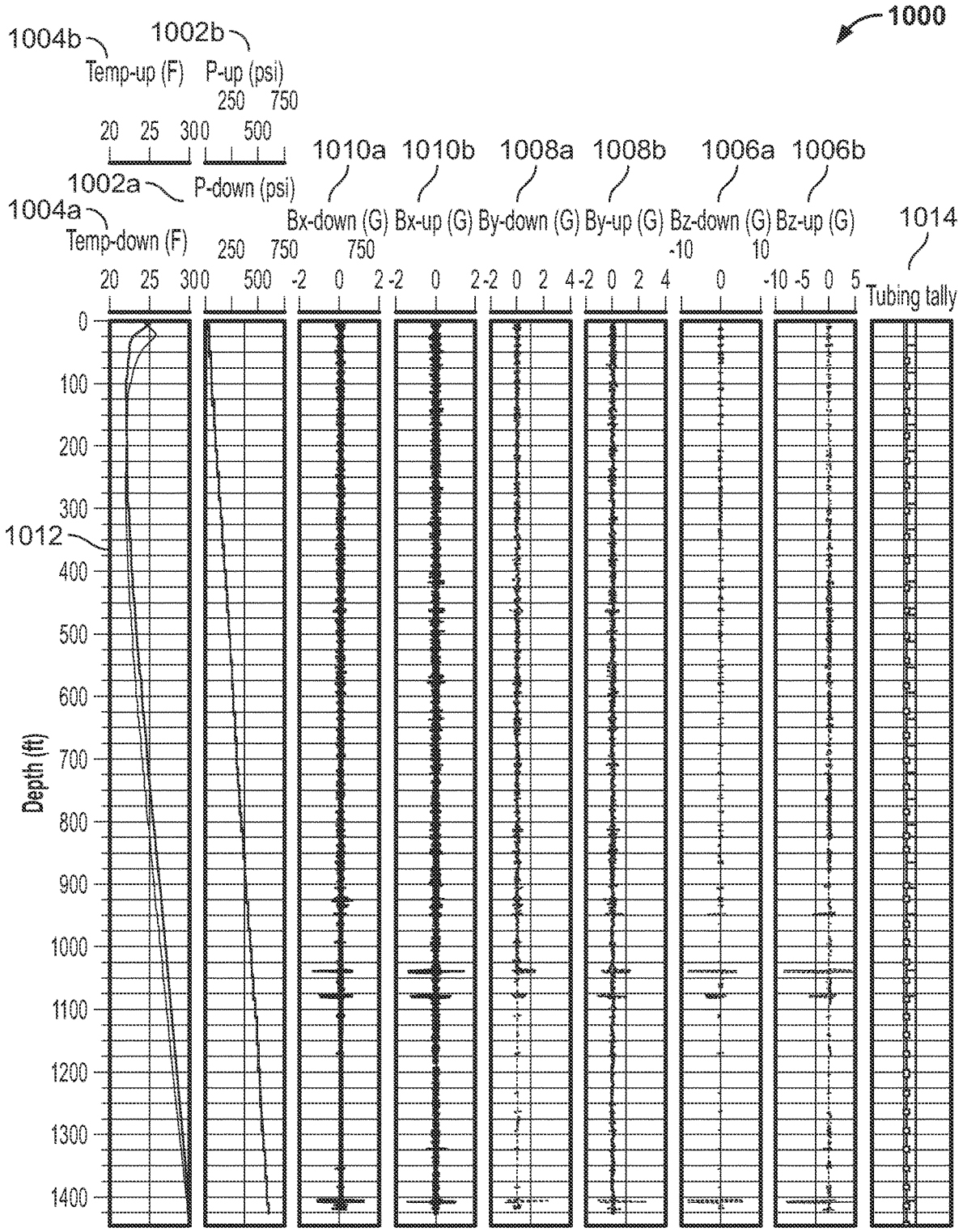

Thus, in some aspects, the depth domain data from graph 800 can be corrected by applying a depth shift in step 308 to each detected peak in order to match the corresponding casing collar locations to the tubing tally. In some aspects, the depth shift may not be linear and can differ from casing joint to casing joint (in other words, tubing to tubing). After applying the depth shift, the data is shown in graph 1000 of FIG. 10. For example, as shown in FIG. 10, graph 1000 illustrates downlog pressure 1002*a* and uplog pressure 1002*b*, downlog temperature 1004*a* and uplog temperature 1004*b*, downlog z-magnetometer 1006*a* and uplog z-magnetometer 1006*b*, downlog y-magnetometer 1008*a* and uplog y-magnetometer 1008*b*, and downlog x-magnetometer 1010*a* and uplog x-magnetometer 1010*b*. These parameters are plotted in depth-domain relative to wellbore depth 1012 (in feet).

Method 300 can include additional steps. For example, the illustrated graphs of FIGS. 4-10 can be generated in the step-by-step process of method 300 and presented to an operator on a graphical user interface (GUI). Further, as described, certain steps (such as step 302) can be repeated to produce a large corpus of collected date for quality control and confirmation.

As described with reference to method 300, the tool speed correction and correlations with the tubing tally and magnetometer data can be used to transform data from a time- to depth-domain. By doing so, for example, depth-domain data can be produced with a wireline quality and display but with an untethered downhole tool independent of a downhole conveyance (such as a wireline).

Indeed, the depth-domain graph 1000 can represent a paradigm shift in the logging and intervention industry. Method 300 can be used to qualitatively and quantitatively assess the untethered downhole tool response in downhole conditions. The logged data processed from the time-domain to the depth-domain by method 300 tracks similar parameter data taken by wireline tools. The depth matching of method 300 can eliminate an apparent discrepancy in the pressure profiles and produces a perfect match between the two data sets (downlog and uplog). The resultant gradients can match the fluid sample analysis and calculated gradient from other pressure sensors.

In some aspects, use of tri-axial magnetometer data as a check on casing collar detection in method 300 can result in multiple quality control points as well as use as the depth correlation with reference to a completion tubing tally. Having such expansive data (for example, with six channels) can increase detection accuracy and collar location confidence, which results in a reliable alternative to a conventional casing collar locator. Thus, the untethered downhole tool can help attend wells where accessibility of standard wireline and slickline tools might be challenging due to sophisticated well completion.

Figure 11:
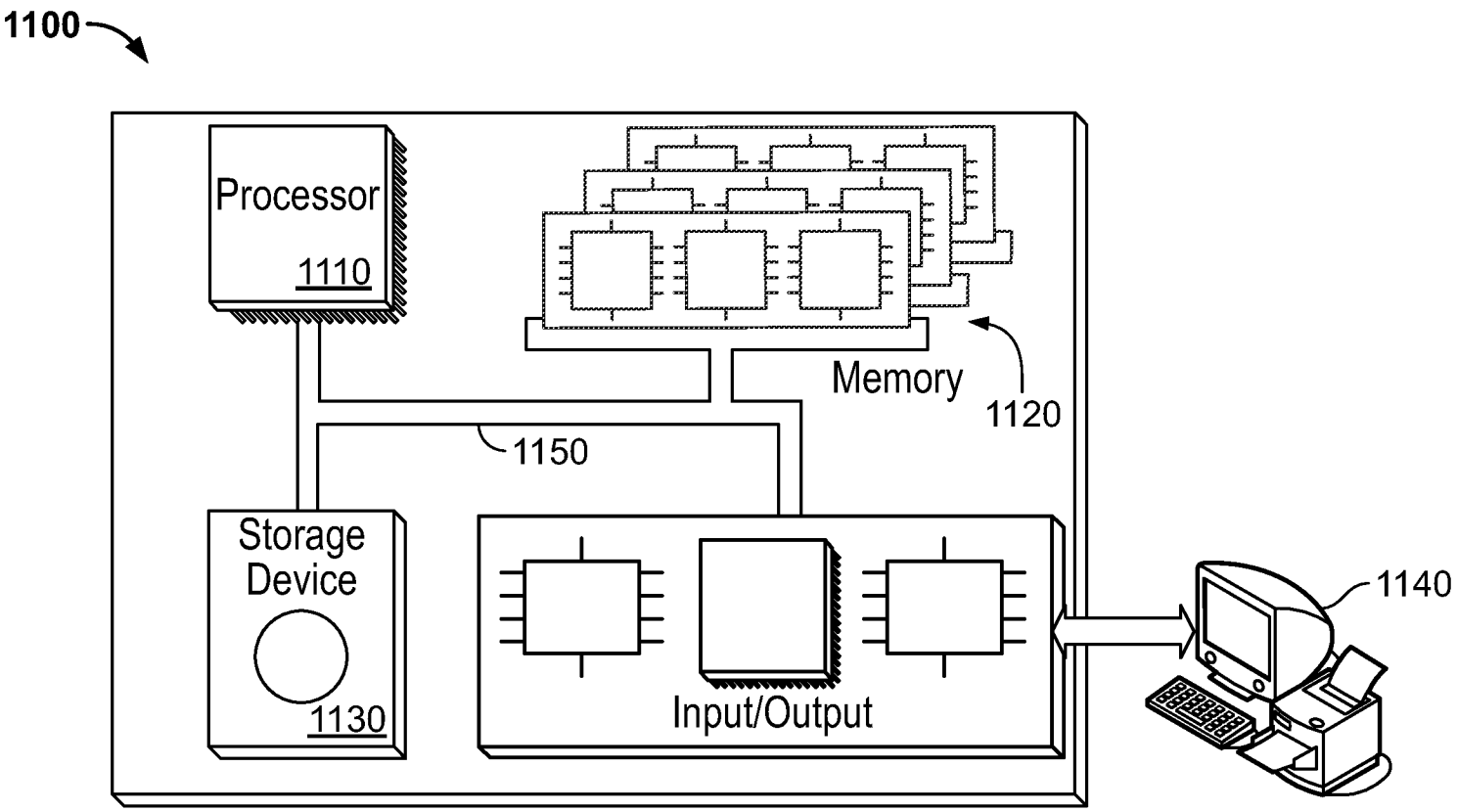
FIG. 11 is a schematic illustration of an example control system of an untethered downhole tool system according to the present disclosure.

FIG. 11 is a schematic illustration of an example controller 1100 (or control system) for an untethered downhole tool, such as the untethered downhole tool 100. For example, all or parts of the controller 1100 can be used for the operations described previously, for example as or as part of the control system 15. The controller 1100 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 1100 includes a processor 1110, a memory 1120, a storage device 1130, and an input/output device 1140. Each of the components 1110, 1120, 1130, and 1140 are interconnected using a system bus 1150. The processor 1110 is capable of processing instructions for execution within the controller 1100. The processor may be designed using any of a number of architectures. For example, the processor 1110 may be a CISC (Complex Instruction Set Computers) processor, a RISC (Reduced Instruction Set Computer) processor, or a MISC (Minimal Instruction Set Computer) processor.

In one implementation, the processor 1110 is a single-threaded processor. In another implementation, the processor 1110 is a multi-threaded processor. The processor 1110 is capable of processing instructions stored in the memory 1120 or on the storage device 1130 to display graphical information for a user interface on the input/output device 1140.

The memory 1120 stores information within the controller 1100. In one implementation, the memory 1120 is a computer-readable medium. In one implementation, the memory 1120 is a volatile memory unit. In another implementation, the memory 1120 is a non-volatile memory unit.

The storage device 1130 is capable of providing mass storage for the controller 1100. In one implementation, the storage device 1130 is a computer-readable medium. In various different implementations, the storage device 1130 may be a floppy disk device, a hard disk device, an optical disk device, a tape device, flash memory, a solid state device (SSD), or a combination thereof.

The input/output device 1140 provides input/output operations for the controller 1100. In one implementation, the input/output device 1140 includes a keyboard and/or pointing device. In another implementation, the input/output device 1140 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method, comprising:

during moving of an untethered downhole tool through a wellbore between a surface and a particular depth, acquiring a set of sensed data from one or more sensors in the untethered downhole tool in a time-domain, the set of sensed data comprising a plurality of data values associated with a wellbore parameter in the time-domain, at least one accelerometer output, and locations of a plurality of casing collars of a casing string in the wellbore;

transforming the plurality of data values associated with the wellbore parameter in the time-domain into a plurality of data values associated with the wellbore parameter in a depth-domain based at least in part on the at least one accelerometer output and the locations of the plurality of casing collars, the plurality of data values separated into split data sets comprising (i) a downlog of a portion of the plurality of data values associated with the wellbore parameter while the untethered downhole tool moves in the wellbore from an uphole location at the surface toward the particular depth in the wellbore and (ii) an uplog of another portion of the plurality of data values associated with the wellbore parameter while the untethered downhole tool moves in the wellbore from the particular depth in the wellbore toward the uphole location; and providing the plurality of data values associated with the wellbore parameter in the depth-domain to a graphical user interface.

2. The method of claim 1, further comprising pre-processing the plurality of data values associated with the wellbore parameter in the time-domain.

3. The method of claim 2, wherein the transforming comprises:

generating a concatenated time-series data set of the plurality of data values associated with the wellbore parameter in the time-domain from the pre-processed plurality of data values associated with the wellbore parameter in the time-domain;

generating the split data sets from the concatenated time-series data set of the plurality of data values associated with the wellbore parameter, the split data sets comprising the downlog of the portion of the plurality of data values associated with the wellbore parameter and the uplog of the another portion of the plurality of data values associated with the wellbore parameter; and applying the locations of the plurality of casing collars to the generated split data sets.

4. The method of claim 3, wherein generating the concatenated time-series data set of the plurality of data values associated with the wellbore parameter in the time-domain comprises:

converting the pre-processed plurality of data values associated with the wellbore parameter in the time-domain into time-series data;

transforming the time-series data into the concatenated time-series data set of the plurality of data values associated with the wellbore parameter in the time-domain;

generating a tubing tally data set;

determining at least two data clipping points based on a wellhead location and total depth of the wellbore based on the plurality of data values associated with the wellbore parameter in the time-domain; and clipping the concatenated time-series data set at the at least two data clipping points.

5. The method of claim 4, wherein generating split data sets from the concatenated timeseries data set of the plurality of data values associated with the wellbore parameter comprises:

splitting the concatenated time-series data set at the data clipping point that represents the total depth of the wellbore;

generating the downlog of the portion of the plurality of data values associated with the wellbore parameter that occur prior in time to the clipping point that represents the total depth of the wellbore;

generating the uplog of the another portion of the plurality of data values associated with the wellbore parameter that occur subsequent in time to the clipping point that represents the total depth of the wellbore;

rescaling the downlog and the uplog to match a top and a bottom of the tubing tally data set; and aligning the rescaled downlog and rescaled uplog based on the at least one accelerometer output to generate an initial plurality of data values associated with the wellbore parameter in the depth-domain.

6. The method of claim 5, wherein applying the locations of the plurality of casing collars to the generated split data sets comprises:

executing a casing collar location detection process to add casing collar locations to the initial plurality of data values associated with the wellbore parameter in the depth-domain;

removing false positive casing collar locations from the initial plurality of data values associated with the wellbore parameter in the depth-domain; and applying a depth shift to the initial plurality of data values associated with the wellbore parameter in the depth-domain to generate the plurality of data values associated with the wellbore parameter in the depth-domain.

7. The method of claim 1, further comprising:

repeating the moving the untethered downhole tool through the wellbore between the surface and the particular depth in the wellbore; and during each repetition of the moving, acquiring a new set of sensed data from the one or more sensors in the untethered downhole tool in the time-domain.

8. The method of claim 1, wherein moving the untethered downhole tool through the wellbore between the surf ace and the particular depth in the wellbore comprises moving the untethered downhole tool through the wellbore between the surface and the particular depth in the wellbore independent of a downhole conveyance.

9. An untethered downhole tool system, comprising:

an untethered downhole tool configured to move through a wellbore between a surface and a particular depth in the wellbore independent of a downhole conveyance, the wellbore comprising a casing string comprising a plurality of casing collars, the untethered downhole tool comprising one or more sensors; and a control system communicably coupled to the untethered downhole tool and configured to perform operations comprising:

identifying a set of sensed data acquired from the one or more sensors in a time-domain, the set of sensed data comprising a plurality of data values associated with a wellbore parameter in the time-domain, at least one accelerometer output, and locations of the plurality of casing collars, transforming the plurality of data values associated with the wellbore parameter in the time-domain into a plurality of data values associated with the wellbore parameter in a depth-domain based at least in part on the at least one accelerometer output and the locations of the plurality of casing collars, the plurality of data values separated into split data sets comprising (i) a downlog of a portion of the plurality of data values associated with the wellbore parameter while the untethered downhole tool moves in the wellbore from an uphole location at the surf ace toward the particular depth in the wellbore and (ii) an uplog of another portion of the plurality of data values associated with the wellbore parameter while the untethered downhole tool moves in the wellbore from the particular depth in the wellbore toward the uphole location, and providing the plurality of data values associated with the wellbore parameter in the depth-domain to a graphical user interface.

10. The untethered downhole tool system of claim 9, wherein the control system is configured to perform operations comprising pre-processing the plurality of data values associated with the wellbore parameter in the time-domain.

11. The untethered downhole tool system of claim 10, wherein the operation of pre-processing comprises formatting the plurality of data values associated with the wellbore parameter in the time-domain into a particular file type.

12. The untethered downhole tool system of claim 10, wherein the operation of transforming comprises:

generating a concatenated time-series data set of the plurality of data values associated with the wellbore parameter in the time-domain from the pre-processed plurality of data values associated with the wellbore parameter in the time-domain, generating the split data sets from the concatenated time-series data set of the plurality of data values associated with the wellbore parameter, the split data sets comprising the downlog of the portion of the plurality of data values associated with the wellbore parameter and the uplog of the another portion of the plurality of data values associated with the wellbore parameter, and applying the locations of the plurality of casing collars to the generated split data sets.

13. The untethered downhole tool system of claim 12, wherein the operation of generating the concatenated timeseries data set of the plurality of data values associated with the wellbore parameter in the time-domain comprises:

converting the pre-processed plurality of data values associated with the wellbore parameter in the time-domain into time-series data, transforming the time-series data into the concatenated time-series data set of the plurality of data values associated with the wellbore parameter in the time-domain, generating a tubing tally data set, determining at least two data clipping points based on a wellhead location and total depth of the wellbore based on the plurality of data values associated with the wellbore parameter in the time-domain, and clipping the concatenated time-series data set at the at least two data clipping points.

14. The untethered downhole tool system of claim 13, wherein the operation of generating split data sets from the concatenated time-series data set of the plurality of data values associated with the wellbore parameter comprises:

splitting the concatenated time-series data set at the data clipping point that represents the total depth of the wellbore, generating the downlog of the portion of the plurality of data values associated with the wellbore parameter that occur prior in time to the clipping point that represents the total depth of the wellbore, generating the uplog of the another portion of the plurality of data values associated with the wellbore parameter that occur subsequent in time to the clipping point that represents the total depth of the wellbore, rescaling the downlog and the uplog to match a top and a bottom of the tubing tally data set, and aligning the rescaled downlog and rescaled uplog based on the at least one accelerometer output to generate an initial plurality of data values associated with the wellbore parameter in the depth-domain.

15. The untethered downhole tool system of claim 14, wherein the operation of applying the locations of the plurality of casing collars to the generated split data sets comprises:

executing a casing collar location detection process to add casing collar locations to the initial plurality of data values associated with the wellbore parameter in the depth-domain, removing false positive casing collar locations from the initial plurality of data values associated with the wellbore parameter in the depth-domain, and applying a depth shift to the initial plurality of data values associated with the wellbore parameter in the depth-domain to generate the plurality of data values associated with the wellbore parameter in the depth-domain.

16. The untethered downhole tool system of claim 9, wherein the control system is configured to perform operations comprising:

identifying a new set of sensed data from the one or more sensors in the untethered downhole tool in the time-domain taken during repeated movings of the untethered downhole tool through the wellbore between the surface and the particular depth in the wellbore, each new set of data comprising a plurality of data values associated the wellbore parameter in the time-domain and at least one new accelerometer output.

17. A non-transitory computer readable medium that comprises instructions operable, when executed by one or more hardware processors, to cause the one or more hardware processors to perform operations comprising:

identifying a set of sensed data acquired from one or more sensors of an untethered downhole tool in a time-domain as the untethered downhole tool moves through a wellbore between a surf ace and a particular depth in the wellbore independent of a downhole conveyance, the wellbore comprising a casing string comprising a plurality of casing collars, the set of sensed data comprising a plurality of data values associated with a wellbore parameter in the time-domain, at least one accelerometer output, and locations of the plurality of casing collars;

transforming the plurality of data values associated with the wellbore parameter in the time-domain into a plurality of data values associated with the wellbore parameter in a depth-domain based at least in part on the at least one accelerometer output and the locations of the plurality of casing collars, the plurality of data values separated into split data sets comprising (i) a downlog of a portion of the plurality of data values associated with the wellbore parameter while the untethered downhole tool moves in the wellbore from an uphole location at the surface toward the particular depth in the wellbore and (ii) an uplog of another portion of the plurality of data values associated with the wellbore parameter while the untethered downhole tool moves in the wellbore from the particular depth in the wellbore toward the uphole location; and providing the plurality of data values associated with the wellbore parameter in the depth-domain to a graphical user interface.

18. The non-transitory computer readable medium of claim 17, wherein the operations comprise pre-processing the plurality of data values associated with the wellbore parameter in the time-domain.

19. The non-transitory computer readable medium of claim 18, wherein the operation of preprocessing comprises formatting the plurality of data values associated with the wellbore parameter in the time-domain into a particular file type.

20. The non-transitory computer readable medium of claim 18, wherein the operation of transforming comprises:

generating a concatenated time-series data set of the plurality of data values associated with the wellbore parameter in the time-domain from the pre-processed plurality of data values associated with the wellbore parameter in the time-domain;

generating the split data sets from the concatenated time-series data set of the plurality of data values associated with the wellbore parameter, the split data sets comprising the downlog of the portion of the plurality of data values associated with the wellbore parameter and the uplog of the another portion of the plurality of data values associated with the wellbore parameter; and applying the locations of the plurality of casing collars to the generated split data sets.

21. The non-transitory computer readable medium of claim 20, wherein the operation of generating the concatenated time-series data set of the plurality of data values associated with the wellbore parameter in the time-domain comprises:

converting the pre-processed plurality of data values associated with the wellbore parameter in the time-domain into time-series data;

transforming the time-series data into the concatenated time-series data set of the plurality of data values associated with the wellbore parameter in the time-domain;

generating a tubing tally data set;

determining at least two data clipping points based on a wellhead location and total depth of the wellbore based on the plurality of data values associated with the wellbore parameter in the time-domain; and clipping the concatenated time-series data set at the at least two data clipping points.

22. The non-transitory computer readable medium of claim 21, wherein the operation of generating split data sets from the concatenated time-series data set of the plurality of data values associated with the wellbore parameter comprises:

splitting the concatenated time-series data set at the data clipping point that represents the total depth of the wellbore;

generating the downlog of the portion of the plurality of data values associated with the wellbore parameter that occur prior in time to the clipping point that represents the total depth of the wellbore;

generating the uplog of the another portion of the plurality of data values associated with the wellbore parameter that occur subsequent in time to the clipping point that represents the total depth of the wellbore;

rescaling the downlog and the uplog to match a top and a bottom of the tubing tally data set; and aligning the rescaled downlog and rescaled uplog based on the at least one accelerometer output to generate an initial plurality of data values associated with the wellbore parameter in the depth-domain.

23. The non-transitory computer readable medium of claim 22, wherein the operation of applying the locations of the plurality of casing collars to the generated split data sets comprises:

executing a casing collar location detection process to add casing collar locations to the initial plurality of data values associated with the wellbore parameter in the depth-domain;

removing false positive casing collar locations from the initial plurality of data values associated with the wellbore parameter in the depth-domain; and applying a depth shift to the initial plurality of data values associated with the wellbore parameter in the depth-domain to generate the plurality of data values associated with the wellbore parameter in the depth-domain.

24. The non-transitory computer readable medium of claim 17, wherein the operations comprise:

identifying a new set of sensed data from the one or more sensors in the untethered downhole tool in the time-domain taken during repeated movings of the untethered downhole tool through the wellbore between the surface and the particular depth in the wellbore, each new set of data comprising a plurality of data values associated the wellbore parameter in the time-domain and at least one new accelerometer output.

25. A method, comprising:

during moving of an untethered downhole tool through a wellbore between a surface and a particular depth, acquiring a set of sensed data from one or more sensors in the untethered downhole tool in a time-domain, the set of sensed data comprising a plurality of data values associated with a wellbore parameter in the time-domain, at least one accelerometer output, and locations of a plurality of casing collars of a casing string in the wellbore;

transforming the plurality of data values associated with the wellbore parameter in the time-domain into a plurality of data values associated with the wellbore parameter in a depth-domain based at least in part on the at least one accelerometer output and the locations of the plurality of casing collars, the transforming comprising:

generating a concatenated time-series data set of the plurality of data values associated with the wellbore parameter in the time-domain from the plurality of data values associated with the wellbore parameter in the time-domain;

generating split data sets from the concatenated time-series data set of the plurality of data values associated with the wellbore parameter, the split data sets comprising a downlog of a portion of the plurality of data values associated with the wellbore parameter and an uplog of another portion of the plurality of data values associated with the wellbore parameter; and applying the locations of the plurality of casing collars to the generated split data sets; and providing the plurality of data values associated with the wellbore parameter in the depth-domain to a graphical user interface.

* * * * *